US009734762B2

(12) United States Patent
Kishi et al.

(10) Patent No.: US 9,734,762 B2
(45) Date of Patent: Aug. 15, 2017

(54) COLOR DISPLAY DEVICE WITH PIXEL CIRCUITS INCLUDING TWO CAPACITORS

(71) Applicant: Sharp Kabushiki Kaisha, Osaka-shi (JP)

(72) Inventors: Noritaka Kishi, Osaka (JP); Noboru Noguchi, Osaka (JP); Masanori Ohara, Osaka (JP); Shigetsugu Yamanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 150 days.

(21) Appl. No.: 14/355,573

(22) PCT Filed: Oct. 26, 2012

(86) PCT No.: PCT/JP2012/077721
§ 371 (c)(1),
(2) Date: Apr. 30, 2014

(87) PCT Pub. No.: WO2013/065594
PCT Pub. Date: May 10, 2013

(65) Prior Publication Data

US 2014/0340377 A1 Nov. 20, 2014

(30) Foreign Application Priority Data

Nov. 2, 2011 (JP) ..... 2011-241327

(51) Int. Cl.
*G09G 3/32* (2016.01)
*G09G 3/3258* (2016.01)
(Continued)

(52) U.S. Cl.
CPC ..... *G09G 3/3258* (2013.01); *G09G 3/3225* (2013.01); *G09G 3/3275* (2013.01);
(Continued)

(58) Field of Classification Search
CPC .. G09G 3/3275; G09G 3/3283; G09G 3/3291; G09G 3/3225; G09G 3/3233;
(Continued)

(56) References Cited

U.S. PATENT DOCUMENTS 6,441,560 B1 * 8/2002 Hunter ..... G09G 3/3233 313/505
2003/0132931 A1 7/2003 Kimura et al.
(Continued)

FOREIGN PATENT DOCUMENTS

JP 2003-202833 A 7/2003
JP 2004-310006 A 11/2004
(Continued)

OTHER PUBLICATIONS

International Search Report received for PCT Patent Application No. PCT/JP2012/077721, mailed on Jan. 29, 2013, 4 pages (2 pages of English translation and 2 pages of ISR).

*Primary Examiner* — Lisa Landis
(74) *Attorney, Agent, or Firm* — Morrison & Foerster LLP

(57) ABSTRACT

In a pixel circuit (10), TFTs (12) to (16) are connected and driven such that a threshold voltage Vth of a TFT (11), which is a drive transistor, can be held in a threshold holding capacitor (19) having a capacitance value c1, voltages, including a data potential Vdata representing an image to be displayed, can be held in a data holding capacitor (18) having a capacitance value c2, and charges in the data holding capacitor (18) and the threshold holding capacitor (19) are redistributed at the time of light emission. As a result, a potential obtained by multiplying the data potential Vdata by c1/(c1+c2) is provided to a gate potential of the TFT (11).

4 Claims, 22 Drawing Sheets

(51) Int. Cl.

| | |
|---|---|
| ***G09G 3/3225*** | (2016.01) |
| ***G09G 3/3283*** | (2016.01) |
| ***G09G 3/3291*** | (2016.01) |
| ***G09G 3/3275*** | (2016.01) |

(52) U.S. Cl.
CPC ..... *G09G 3/3283* (2013.01); *G09G 3/3291* (2013.01); *G09G 2300/0819* (2013.01); *G09G 2300/0852* (2013.01); *G09G 2300/0861* (2013.01); *G09G 2300/0866* (2013.01); *G09G 2310/0259* (2013.01); *G09G 2320/0242* (2013.01)

(58) Field of Classification Search
CPC ... G09G 2300/0866; G09G 2300/0852; G09G 2300/0861; G09G 2300/0819; G09G 2310/0259; G09G 2320/0242
See application file for complete search history.

(56) References Cited

U.S. PATENT DOCUMENTS

| | | | | |
|---|---|---|---|---|
| 2004/0196239 | A1 | 10/2004 | Kwon | |
| 2005/0017934 | A1 | 1/2005 | Chung et al. | |
| 2005/0156515 | A1* | 7/2005 | Fukase | H01L 27/3211 313/504 |
| 2006/0103322 | A1 | 5/2006 | Chung et al. | |
| 2007/0085847 | A1* | 4/2007 | Shishido | G09G 3/3233 345/204 |
| 2007/0118781 | A1 | 5/2007 | Kim | |
| 2008/0111804 | A1* | 5/2008 | Choi | G09G 3/3233 345/205 |
| 2008/0158114 | A1 | 7/2008 | Kim | |
| 2008/0316150 | A1* | 12/2008 | Lee | G09G 3/3233 345/76 |
| 2009/0066615 | A1* | 3/2009 | Kawasaki | G09G 3/3233 345/77 |
| 2010/0013748 | A1* | 1/2010 | Cok | H04N 9/67 345/83 |
| 2010/0289830 | A1 | 11/2010 | Yamamoto et al. | |
| 2011/0025671 | A1 | 2/2011 | Lee | |
| 2012/0249602 | A1* | 10/2012 | Liu | G09G 3/2003 345/690 |

FOREIGN PATENT DOCUMENTS

| | | | |
|---|---|---|---|
| JP | 2005-31630 | A | 2/2005 |
| JP | 2007-79580 | A | 3/2007 |
| JP | 2008-165166 | A | 7/2008 |
| JP | 2009-86654 | A | 4/2009 |
| JP | 2009-198761 | | 9/2009 |
| JP | 2010-266494 | A | 11/2010 |
| JP | 2011-34039 | A | 2/2011 |

* cited by examiner

COLOR DISPLAY DEVICE WITH PIXEL CIRCUITS INCLUDING TWO CAPACITORS

CROSS REFERENCE TO RELATED APPLICATIONS

This is the U.S. National Phase patent application of PCT/JP2012/077721, filed Oct. 26, 2012, which claims priority to Japanese Patent Application No. 2011-241327, filed Nov. 2, 2011, each of which is hereby incorporated by reference in the present disclosure in its entirety.

TECHNICAL FIELD

The present invention relates to display devices, and more specifically, the invention relates to a display device, such as an organic EL display, which includes light-emitting display elements driven by a current, and a method for driving the same.

BACKGROUND ART

Organic EL (electroluminescent) displays are conventionally known as being thin display devices featuring high image quality and low power consumption. The organic EL display has a plurality of pixel circuits arranged in a matrix, each circuit including an organic EL element, which is a light-emitting display element driven by a current, and a drive transistor for driving the element.

The method for controlling the amount of current to be applied to current-driven display elements such as organic EL elements as above are generally classified into: a constant-current control mode (or a current-programmed drive mode) in which the current that is to be applied to display elements is controlled by data signal currents flowing through data signal line electrodes of the display elements; and a constant-voltage control mode (or a voltage-programmed drive mode) in which the current that is to be applied to display elements is controlled by voltages corresponding to data signal voltages. Among these modes, when the constant-voltage control mode is used for display on an organic EL display, it is necessary to compensate for current reduction (luminance decay) due to variations in the threshold voltage among drive transistors and increased resistance caused by deterioration of organic EL elements over time. On the other hand, in the case of the constant-current control mode, the values for data signal currents are controlled such that constant currents are applied to organic EL elements regardless of the threshold voltages and internal resistance of the organic EL elements, and therefore, the compensation as mentioned above is normally unnecessary. However, the constant-current control mode is known to require more drive transistors and more wiring lines than the constant-voltage control mode, which leads to a lower aperture ratio, and therefore, the constant-voltage control mode is widely employed.

Here, various configurations of pixel circuits that are employed with the constant-voltage control mode and perform compensation operations as above are conventionally known. Japanese Laid-Open Patent Publication No. 2005-31630 describes a pixel circuit 91 shown in FIG. 20.

FIG. 20 is a circuit diagram of the pixel circuit 91. The pixel circuit 91 includes six TFTs (thin-film transistors) 11 to 16, an organic EL element 17, and a capacitor 18, as shown in FIG. 20. All of the six TFTs 11 to 16 are p-channel transistors. Moreover, the pixel circuit 91 is connected to two scanning signal lines $G_i$ and $G_{(i-1)}$, a control line $E_i$, a data line $S_j$, a pair of power lines $VP_j$, and an electrode having a common potential Vcom. The TFT 11 has a source terminal connected to one conductive terminal of the TFT 13 and one conductive terminal of the TFT 15, and the TFT 11 also has a drain terminal connected to one conductive terminal of the TFT 12 and one conductive terminal of the TFT 14. The other conductive terminal of the TFT 13 is connected to one of the power lines $VP_j$, which provides a power supply potential VDD. The other conductive terminal of the TFT 15 is connected to the data line $S_j$. The other conductive terminal of the TFT 14 is connected to an anode terminal of the organic EL element 17. The aforementioned conductive terminal of the TFT 12 is connected to a gate terminal of the TFT 11, and the other conductive terminal of the TFT 12 is connected to the drain terminal of the TFT 11. The TFT 16 is connected at one conductive terminal to the other power line $VP_j$, which provides an initialization potential Vini, and at the other conductive terminal to a control terminal of the TFT 11. The data holding capacitor 18 is connected at one terminal to the control terminal of the TFT 11 as well and at the other terminal to the power line $VP_j$ that provides the power supply potential VDD. The organic EL element 17 has the common potential Vcom applied at its cathode terminal. The scanning signal line $G_i$ is connected to a gate terminal of each of the TFTs 12 and 15. The scanning signal line $G_{(i-1)}$ is connected to a gate terminal of the TFT 16. The control line $E_i$ is connected to a gate terminal of each of the TFTs 13 and 14.

Furthermore, US Patent Application Publication No. 2006/103322 describes a pixel circuit 92 shown in FIG. 21. FIG. 21 is a circuit diagram of the pixel circuit 92. The pixel circuit 92 includes six TFTs 21 to 26, an organic EL element 17, and a data holding capacitor 28, as shown in FIG. 21. All of the six TFTs 21 to 26 are p-channel transistors. Moreover, the pixel circuit 92 is connected to a scanning signal line $G_i$, a control line $E_i$, an initialization control line $I_i$, a data line $S_j$, a pair of power lines $VP_j$, and an electrode having a common potential Vcom. The TFT 22 has a source terminal connected to one of the power lines $VP_j$, which provides a power supply potential VDD, and the TFT 22 also has a drain terminal connected to one conductive terminal of the TFT 23. The other conductive terminal of the TFT 23 is connected to a gate terminal of the TFT 22. Moreover, the TFT 25 is connected at one conductive terminal to a drain terminal of the TFT 22 and at the other conductive terminal to an anode terminal of the organic EL element 17. Furthermore, the TFT 21 is connected at one conductive terminal to the data line $S_j$ and at the other conductive terminal to one terminal of the data holding capacitor 28. The TFTs 24 and 26 are connected at one conductive terminal to the other power line $VP_j$, which provides an initialization potential Vini. The TFT 24 is connected at the other conductive terminal to the other terminal of the data holding capacitor 28, and the other conductive terminal of the TFT 26 is connected to the opposite terminal of the data holding capacitor 28. The other terminal of the data holding capacitor 28 is connected to the gate terminal of the TFT 22. The organic EL element 17 has the common potential Vcom applied at its cathode terminal. The scanning signal line $G_i$ is connected to a gate terminal of each of the TFTs 21 and 23. The initialization control line $I_i$ is connected to a gate terminal of the TFT 24. The control line $E_i$ is connected to a gate terminal of each of the TFTs 25 and 26.

Furthermore, Japanese Laid-Open Patent Publication No. 2003-202833 describes a pixel circuit 93 shown in FIG. 22. FIG. 22 is a circuit diagram of the pixel circuit 93. The pixel circuit 93 includes six TFTs 31 to 36, an organic EL element 17, and a data holding capacitor 38, as shown in FIG. 22. All of the six TFTs 31 to 36 are n-channel transistors. The pixel circuit 93 is connected to a scanning signal line $G_i$, control lines $Ea_i$ to $Ed_i$, a data line $S_j$, a power line $VP_j$, and an electrode having a common potential Vcom. The TFT 31, which is a drive transistor, has a drain terminal connected to the power line $VP_j$, which provides a power supply potential VDD, via the TFT 35 on a current path. Moreover, the TFT 31 has a source terminal connected to an anode terminal of the organic EL element 17 via the TFT 32 on a current path. The TFT 36 is connected at one conductive terminal to the drain terminal of the TFT 31 and at the other conductive terminal to a gate terminal of the TFT 31. Moreover, the TFT 34 is connected at one conductive terminal to the data line $S_j$ and at the other conductive terminal to the source terminal of the TFT 31. Furthermore, the data holding capacitor 38 is connected at one terminal to the electrode having the common potential Vcom via the TFT 33. The terminal of the data holding capacitor 38 is also connected to the source terminal of the TFT 31 via the TFT 32. The organic EL element 17 has the common potential Vcom applied at its cathode terminal. The scanning signal line $G_i$ is connected to a gate terminal of the TFT 34. Moreover, the control line $Ed_i$ is connected to a gate terminal of the TFT 33. Furthermore, the control line $Ea_i$ is connected to a gate terminal of the TFT 36. The control line $Ec_i$ is connected to a gate terminal of the TFT 32. Moreover, the control line $Eb_i$ is connected to a gate terminal of the TFT 35.

Furthermore, Japanese Laid-Open Patent Publication No. 2011-34039 describes a pixel circuit 94 shown in FIG. 23. FIG. 23 is a circuit diagram of the pixel circuit 94. The pixel circuit 94 includes three TFTs 41 to 43, an organic EL element 17, two data holding capacitors 48*a* and 48*b*, and a threshold holding capacitor 49, as shown in FIG. 23. All of the three TFTs 41 to 43 are p-channel transistors. The pixel circuit 94 is connected to a scanning signal line $G_i$, a control line $E_i$, a data line $S_j$, a power line $VP_i$, and an electrode having a common potential Vcom. The TFT 41 is connected at one conductive terminal to the data line $S_j$ and at the other conductive terminal to one terminal of each of the two data holding capacitors 48*a* and 48*b*. Of the two data holding capacitors 48*a* and 48*b*, the data holding capacitor 48*a* is connected at the other terminal to a gate terminal of the TFT 42, and the data holding capacitor 48*b* is connected at the other terminal to the power line $VP_i$. The TFT 42 has a drain terminal connected to the power line $VP_i$ and a source terminal connected to an anode terminal of the organic EL element 17. The organic EL element 17 has the common potential Vcom applied at its cathode terminal. The TFT 43 is connected at one conductive terminal to a gate terminal of the TFT 42 and at the other conductive terminal to a source terminal of the TFT 42. The scanning signal line $G_i$ is connected to a gate terminal of the TFT 41. The control line $E_i$ is connected to a gate terminal of the TFT 43.

Note that Japanese Laid-Open Patent Publication No. 2007-79580 describes a pixel circuit 95 shown in FIG. 24, which is similar to the pixel circuit 92 shown in FIG. 21. FIG. 24 is a circuit diagram of the pixel circuit 95. The pixel circuit 95 includes six TFTs 11 to 16, an organic EL element 17, and a capacitor 18, which are the same components as in the pixel circuit 92, and the pixel circuit 95 further includes an auxiliary capacitor Caux, as shown in FIG. 24. However, the TFT 12 is connected at the conductive terminal to the source terminal, rather than the drain terminal, of the TFT 11. Moreover, the TFT 15 is connected at the conductive terminal to the drain terminal, rather than the source terminal, of the TFT 11. In addition, as with the capacitor 18, the auxiliary capacitor Caux is connected at one terminal to the control terminal of the TFT 11 and at the other end to the scanning signal line $G_i$, the potential of which is variable.

CITATION LIST

Patent Documents

Patent Document 1: Japanese Laid-Open Patent Publication No. 2005-31630

Patent Document 2: US Patent Application Publication No. 2006/103322

Patent Document 3: Japanese Laid-Open Patent Publication No. 2003-202833

Patent Document 4: Japanese Laid-Open Patent Publication No. 2011-34039

Patent Document 5: Japanese Laid-Open Patent Publication No. 2007-79580

SUMMARY OF THE INVENTION

Problems to be Solved by the Invention

All of the pixel circuits 91 to 95 shown in FIGS. 20 to 24 are configured such that a potential having been increased/decreased by a predetermined voltage from the potential Vdata of a video signal line (data line) is provided to a drive transistor. Accordingly, in the case where the difference between the maximum and minimum values (dynamic range) for the potential Vdata of the video signal line is large, an excessive current larger than an appropriate current might be applied to the organic EL element. Therefore, to prevent this, it is necessary to, for example, reduce the output dynamic range of a data driver circuit, or increase the channel length L of the drive transistor, thereby reducing the current capability thereof.

However, if the dynamic range of the data driver circuit is to be reduced in such a manner, data driver circuits having a typical configuration (with a large dynamic range) cannot be used, leading to increased production cost. Moreover, in the case of data driver circuits with a small dynamic range, the output deviation for each grayscale level becomes relatively high, resulting in increased output error.

Furthermore, if the channel length L of the drive transistor is increased, instead of changing the dynamic range of the data driver circuit, in order to reduce the current to be applied to the organic EL element, the pixel circuit is increased in area. As a result, the aperture ratio of the pixel decreases, and further, it becomes difficult to achieve a higher-definition display device.

Therefore, an objective of the present invention is to provide a pixel circuit capable of providing a nonexcessive current (microcurrent) to an organic EL element without reducing the dynamic range of a data driver circuit and increasing the channel length L of a drive transistor, and also to provide a display device including the pixel circuit.

Solution to the Problems

A first aspect of the present invention is directed to an active-matrix color display device comprising:

a plurality of video signal lines for transmitting signals representing an image to be displayed;

a plurality of scanning signal lines and control lines crossing the video signal lines;

pixel circuits arranged in a matrix corresponding to respective intersections of the video signal lines and the scanning signal lines, each pixel circuit displaying a pixel in one of a plurality of primary colors for forming the image to be displayed;

a plurality of power lines for supplying a power-supply voltage to the pixel circuits;

a scanning signal line driver circuit for selectively or collectively driving the scanning signal lines and the control lines;

a video signal line driver circuit for driving the video signal lines by applying the signals representing the image to be displayed; and a power control circuit for driving the power lines, wherein, the pixel circuit includes:

an electro-optic element to be driven by a current provided by the power line being supplied with the power-supply voltage;

a drive transistor provided in a path of the current flowing through the electro-optic element, the transistor determining the current to be flowed through the path;

a data holding capacitor connected at one terminal to a control terminal of the drive transistor and at the other terminal to the power line or a connecting point provided with a predetermined voltage; and a write control transistor connected to the data holding capacitor such that a voltage is provided to the data holding capacitor when the write control transistor is on, and the provided voltage is held in the data holding capacitor when the write control transistor is off, the provided voltage having a value changed by a predetermined value from a voltage obtained by adding or subtracting a voltage corresponding to a video signal representing an image to be displayed to or from a threshold voltage of the drive transistor, each of the pixel circuits for displaying at least one of the primary colors further includes a threshold holding capacitor connected at one terminal to the control terminal of the drive transistor and at the other terminal to a conductive terminal of the drive transistor or a connecting point provided with a predetermined constant voltage, and the write control transistor included in each of the pixel circuits for displaying said at least one of the primary colors is connected to the data holding capacitor such that a voltage is provided to the threshold holding capacitor when the write control transistor is on, and the provided voltage is held in the threshold holding capacitor when the write control transistor is off, the provided voltage being the threshold voltage or having a value changed by a predetermined value from the threshold voltage.

In a second aspect of the present invention, based on the first aspect of the invention, each of pixel circuits display one of the primary colors including first to third primary colors, and the pixel circuits include a first pixel circuit displaying the first primary color and including the threshold holding capacitor.

In a third aspect of the present invention, based on the second aspect of the invention, the pixel circuits include a second pixel circuit displaying the second primary color and including the threshold holding capacitor.

In a fourth aspect of the present invention, based on the third aspect of the invention, a capacitance ratio a of the threshold holding capacitor to the data holding capacitor in the first pixel circuit is lower than a capacitance ratio b of the threshold holding capacitor to the data holding capacitor in the second pixel circuit.

In a fifth aspect of the present invention, based on the fourth aspect of the invention, each of the pixel circuits display one of the first to third primary colors, and the pixel circuits include a third pixel circuit displaying the third primary color and not including the threshold holding capacitor.

In a sixth aspect of the present invention, based on the third aspect of the invention, the pixel circuits include a third pixel circuit displaying the third primary color and including the threshold holding capacitor.

In a seventh aspect of the present invention, based on the sixth aspect of the invention, a capacitance ratio a of the threshold holding capacitor to the data holding capacitor in the first pixel circuit is lower than a capacitance ratio b of the threshold holding capacitor to the data holding capacitor in the second pixel circuit, and the ratio b is lower than a capacitance ratio c of the threshold holding capacitor to the data holding capacitor in the third pixel circuit.

In an eighth aspect of the present invention, based on the second aspect of the invention, the pixel circuits are equal in storage capacitance, the storage capacitance being either combined capacitance of the data holding capacitor and the threshold holding capacitor included in the pixel circuit or capacitance of the data holding capacitor where no threshold holding capacitor is included in the pixel circuit.

In a ninth aspect of the present invention, based on the third aspect of the invention, combined capacitance of the data holding capacitor and the threshold holding capacitor is higher in the first pixel circuit than in the second pixel circuit.

In a tenth aspect of the present invention, based on the ninth aspect of the invention, the pixel circuits include a third pixel circuit displaying the third primary color and including the threshold holding capacitor, and the combined capacitance of the data holding capacitor and the threshold holding capacitor is higher in the second pixel circuit than in the third pixel circuit.

In an eleventh aspect of the present invention, based on the ninth aspect of the invention, the first primary color is blue, the second primary color is green, and the third primary color is red.

In a twelfth aspect of the present invention, based on the second aspect of the invention, the first primary color is red, the second primary color is green, and the third primary color is blue.

In a thirteenth aspect of the present invention, based on the first aspect of the invention, each of pixel circuits display one of the first, second, third, and fourth primary colors being red, green, blue, and white, respectively, the pixel circuits include first and fourth pixel circuits displaying the first and fourth primary colors, respectively, each of the first and fourth pixel circuits including the threshold holding capacitor, and a capacitance ratio d of the threshold holding capacitor to the data holding capacitor in the fourth pixel circuit is lower than a capacitance ratio a of the threshold holding capacitor to the data holding capacitor in the first pixel circuit.

In a fourteenth aspect of the present invention, based on the first aspect of the invention, each of pixel circuits display one of the first, second, third, and fourth primary colors being red, green, blue, and yellow, respectively, the pixel circuits include first and fourth pixel circuits displaying the first and fourth primary colors, respectively, each of the first and fourth pixel circuits including the threshold holding capacitor, and a capacitance ratio d of the threshold holding capacitor to the data holding capacitor in the fourth pixel circuit is higher than a capacitance ratio a of the threshold holding capacitor to the data holding capacitor in the first pixel circuit.

Effect of the Invention

In the first aspect of the present invention, the pixel circuits corresponding to one or more colors include threshold holding capacitors, so that the dynamic range of the voltage provided to the control terminal of the drive transistor can be reduced by c1/(c1+c2) where c1 is the capacitance value of the data holding capacitor, and c2 is the capacitance value of the threshold holding capacitor, whereby it is possible to provide an appropriate, not excessive, amount of current to an electro-optic element included in a pixel circuit for a color with higher luminous efficiency than other colors, such as a red-emitting organic EL element, without changing the dynamic range of the data driver circuit itself (for each color). Moreover, by providing the threshold holding capacitor in an appropriate position, it is possible to achieve a voltage-following effect to deal with an IR drop caused by the locations of the pixel circuits, so that the difference in luminance due to an IR drop can be reduced significantly, and reduction in display quality can be suppressed.

Furthermore, the circuit area of the pixel circuit can be kept from becoming larger than conventional, and by using the (typical) data driver circuit having a large dynamic range, it is possible to further reduce the error in data potential, so that variations in pixel luminance due to output deviation of the data driver circuit can be suppressed. In addition, it is possible to control the electro-optic element with a smaller amount of current without changing the size of the drive transistor, which does not involve the need to change design conditions, production processes, etc., resulting in higher flexibility of design.

In the second aspect of the present invention, the first pixel circuit for displaying the first primary color includes the threshold holding capacitor, and therefore, for example, in the case where the first primary color is red, it is possible to provide an appropriate, not excessive, amount of current to an electro-optic element included in a pixel circuit for a color with higher luminous efficiency than other colors, such as a red-emitting organic EL element.

In the third aspect of the present invention, the second pixel circuit for displaying the second primary color includes the threshold holding capacitor, and therefore, for example, in the case where the second primary color is green, it is possible to provide an appropriate, not excessive, amount of current to an electro-optic element included in a pixel circuit for a color with higher luminous efficiency than other colors, excluding the first primary color, such as a green-emitting organic EL element.

In the fourth aspect of the present invention, a capacitance ratio a in the first pixel circuit is lower than a capacitance ratio bin the second pixel circuit, and therefore, in the case where the electro-optic element for the first primary color (e.g., red) has higher luminous efficiency than the electro-optic element for the second primary color (e.g., green), it is possible to provide a smaller current to the more efficient element, so that an appropriate, not excessive, amount of current can be provided to each electro-optic element.

In the fifth aspect of the present invention, the third pixel circuit for displaying the third primary color (e.g., blue) does not include the threshold holding capacitor, and therefore, it is possible to provide a large current to an electro-optic element with low luminous efficiency (e.g., blue), and a small current to the pixel circuits for displaying the first and second primary colors, so that an appropriate, not excessive, amount of current can be provided to each electro-optic element. Particularly in the case where it is desirable that the colors be rendered equal in emission luminance without changing the dynamic range of the data driver circuit itself (for each color), it is possible to readily set the ratios a and b with reference to the third pixel circuit.

In the sixth aspect of the present invention, the third pixel circuit for displaying the third primary color includes the threshold holding capacitor, and therefore, for example, in the case where the third primary color is blue, (in some cases, the amount of current provided might be excessive depending on the configuration of the data driver circuit, but still) it is possible to provide an appropriate, not excessive, amount of current even to an electro-optic element with low luminous efficiency, e.g., a green-emitting organic EL element.

In the seventh aspect of the present invention, the capacitance ratio a in the first pixel circuit is lower than the capacitance ratio b in the second pixel circuit, and the capacitance ratio b in the second pixel circuit is lower than the capacitance ratio c in the third pixel circuit, so that a weaker current can be provided to an element with good luminous efficiency, and an appropriate, not excessive, amount of current can be provided to each electro-optic element.

The eighth aspect of the present invention allows the pixel circuits to be approximately equal in layout area for capacitance, and therefore, it is possible to provide an appropriate, not excessive, amount of current to each electro-optic element while maintaining the circuit configuration that can be readily designed and produced.

In the ninth aspect of the present invention, the combined capacitance is higher in the first pixel circuit than in the second pixel circuit, and therefore, for example, in the case where more capacitance is required to be stored for the reason that the ratio a in the first pixel circuit is high, it is possible to ensure a sufficient amount of storage capacitance, thereby preventing grayscale error, flicker, etc. Moreover, on the other hand, in the case where the luminous efficiency of an electro-optic element is lower in the second pixel circuit than in the first pixel circuit, it is possible to increase the combined capacitance to increase the aperture ratio, thereby increasing the layout area for capacitance.

In the tenth aspect of the present invention, the combined capacitance is higher in the second pixel circuit than in the third pixel circuit, and therefore, for example, in the case where more capacitance is required to be stored for the reason that the ratio b in the second pixel circuit is high, it is possible to ensure a sufficient amount of storage capacitance, thereby preventing grayscale error, flicker, etc. Moreover, on the other hand, in the case where the luminous efficiency of an electro-optic element is lower in the third pixel circuit than in the second pixel circuit, it is possible to increase the combined capacitance to increases the aperture ratio, thereby increasing the layout area for capacitance.

In the eleventh aspect of the present invention, the first primary color is blue, the second primary color is green, the third primary color is red, and therefore, since the blue and red electro-optic elements have the lowest and highest luminous efficiency, respectively, among typical electro-optic elements such as organic EL elements, the combined capacitance value is increased more for the pixel circuits with higher capacitance ratios, thereby ensuring the storage capacitance.

In the twelfth aspect of the present invention, the first primary color is red, the second primary color is green, the third primary color is blue, and therefore, since the blue and red electro-optic elements have the lowest and highest luminous efficiency, respectively, among typical electro-optic elements such as organic EL elements, an appropriate, not excessive, amount of current can be provided to each electro-optic element.

In the thirteenth aspect of the present invention, the first primary color is red, the second primary color is green, the third primary color is blue, the fourth primary color is white, the capacitance ratio d is lower than the capacitance ratio a, and therefore, the white pixel circuit typically having the highest luminous efficiency (for example, because there is no loss due to a color filter) has the lowest capacitance ratio, so that an appropriate, not excessive, amount of current can be provided to an electro-optic element included in the white pixel circuit with higher luminous efficiency than the other colors.

In the fourteenth aspect of the present invention, the first primary color is red, the second primary color is green, the third primary color is blue, the fourth primary color is yellow, the capacitance ratio d is higher than the capacitance ratio a, and therefore, the capacitance ratio in the yellow pixel circuit typically having lower luminous efficiency than the red pixel circuit is at least higher than that in the red pixel circuit, so that an appropriate, not excessive, amount of current can be provided to an electro-optic element included in the red pixel circuit with the highest luminous efficiency, and also to an electro-optic element included in the yellow pixel circuit with relatively high luminous efficiency.

MODES FOR CARRYING OUT THE INVENTION

First Embodiment

Figure 1:
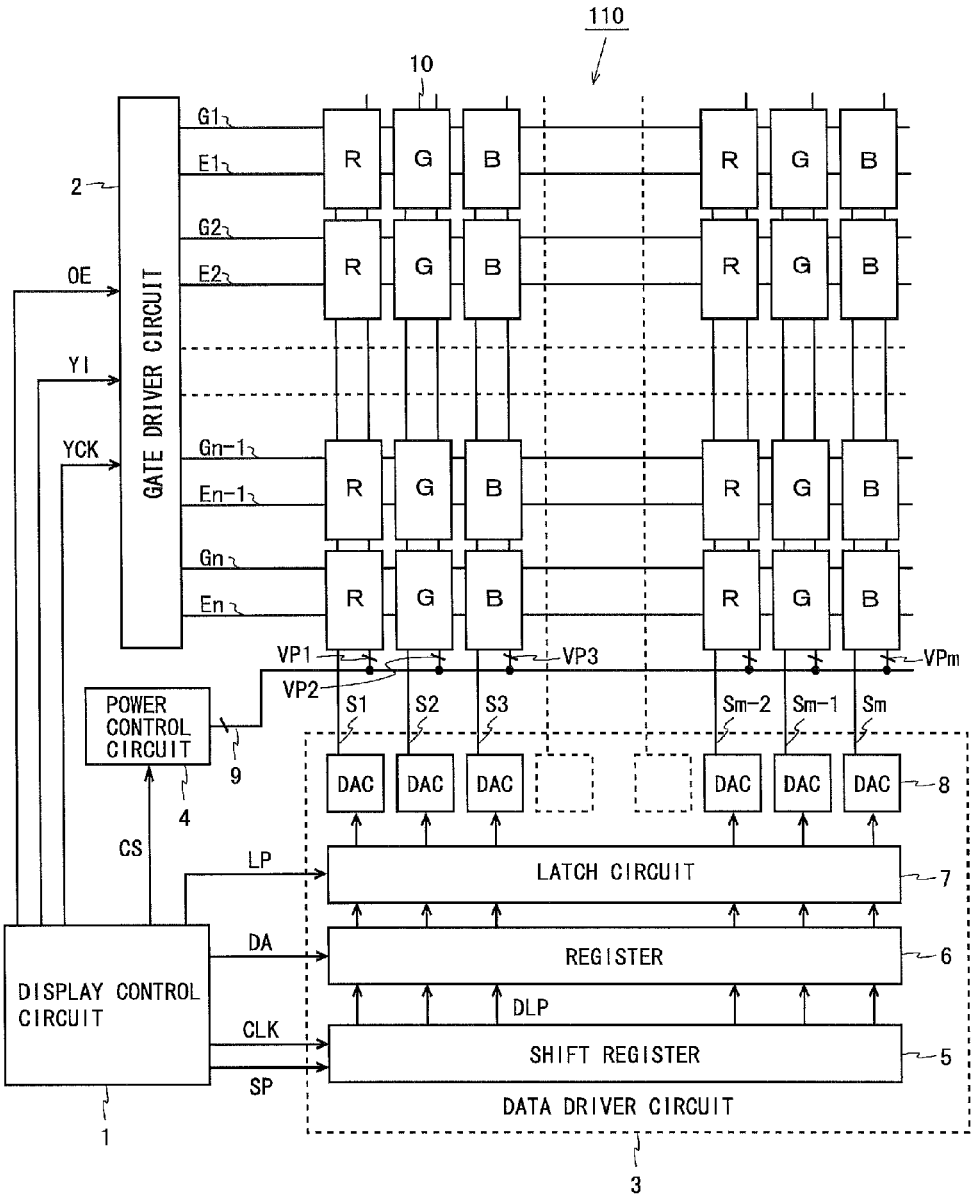
FIG. 1 is a block diagram illustrating the configuration of a display device according to a first embodiment of the present invention.

FIG. 1 is a block diagram illustrating the configuration of a display device according to a first embodiment of the present invention. The display device 110 shown in FIG. 1 is an organic EL display including a display control circuit 1, a gate driver circuit 2, a data driver circuit 3, a power control circuit 4, and (m×n) pixel circuits 10. In the following, m and n are integers of 2 or more, i is an integer greater than or equal to 1 but less than or equal to n, and j is an integer greater than or equal to 1 but less than or equal to m.

The display device 110 is provided with n parallel scanning signal lines $G_i$ and m parallel data lines $S_j$ perpendicular thereto. Although omitted in the figure, there are further provided scanning signal lines $G_0$ for initialization control to be described later. The (m×n) pixel circuits 10 are arranged in a matrix corresponding to the intersections of the scanning signal lines $G_i$ and the data lines $S_j$, and display pixels in respective colors to constitute a display image. Moreover, n control lines $E_i$ are provided parallel to the scanning signal lines $G_i$, and n pairs of power lines $VP_i$ are provided parallel to the data lines $S_j$. In addition, there is also provided a common power line 9, which is a current-supply trunk line for connecting the power control circuit 4 and the power lines $VP_i$. The common power line 9 consists of a pair of wiring portions for providing two potentials to be described later. The scanning signal lines $G_i$ and the control lines $E_i$ are connected to the gate driver circuit 2, and the data lines $S_j$ are connected to the data driver circuit 3. Each pair of the power lines $VP_i$ provides two potentials to be described later, and is connected to the power control circuit 4 via its corresponding portion of the common power line 9. The pixel circuit 10 is supplied with a common potential Vcom by an unillustrated common electrode. Here, each pair of power lines $VP_i$ is connected at one end to the paired portions of the common power line 9, but each pair of power lines $VP_i$ may be connected at both ends (or at three or more connecting points).

The display control circuit 1 outputs control signals to the gate driver circuit 2, the data driver circuit 3, and the power control circuit 4. More specifically, the display control circuit 1 outputs a timing signal OE, a start pulse YI, and a clock YCK to the gate driver circuit 2, a start pulse SP, a clock CLK, display data DA, and a latch pulse LP to the data driver circuit 3, and a control signal CS to the power control circuit 4.

The gate driver circuit 2 includes a shift register circuit, a logical operation circuit, and a buffer (none of the above is shown in the figure). The shift register circuit sequentially transfers the start pulses YI in synchronization with the clock YCK. The logical operation circuit performs a logical operation between the timing signal OE and a pulse outputted from each stage of the shift register circuit. Outputs from the logical operation circuit are provided through the buffer to their corresponding scanning signal lines $G_i$ and control lines $E_i$. Each scanning signal line $G_i$ is connected to m pixel circuits 10, and the m pixel circuits 10 are collectively selected through the scanning signal line $G_i$.

The data driver circuit 3 includes an m-bit shift register 5, a register 6, a latch circuit 7, and m D/A converters 8. The shift register 5 has m cascaded registers, such that a start pulse SP supplied to the register in the first stage is transferred in synchronization with a clock CLK, and the register in each stage outputs a timing pulse DLP. The register 6 is supplied with display data DA in accordance with the output timing of the timing pulses DLP. The register 6 stores the display data DA in accordance with the timing pulses DLP. When the register 6 has stored display data DA for one row, the display control circuit 1 outputs a latch pulse LP to the latch circuit 7. Upon reception of the latch pulse LP, the latch circuit 7 holds the display data stored in the register 6. The D/A converters 8 are provided corresponding to the data lines $S_j$. The D/A converters 8 convert the display data held in the latch circuit 7 into analog voltages, and apply the resultant analog voltages to the data lines $S_j$.

In accordance with the control signal CS, the power control circuit 4 applies a power supply potential VDD to one of the paired portions of the common power line 9 and an initialization potential Vini to the other portion. Since each pair of power lines $VP_i$ is connected to the common power line 9, as shown in FIG. 1, one of the power lines $VP_i$ is set at the power supply potential and the other at the initialization potential.

Figure 2:
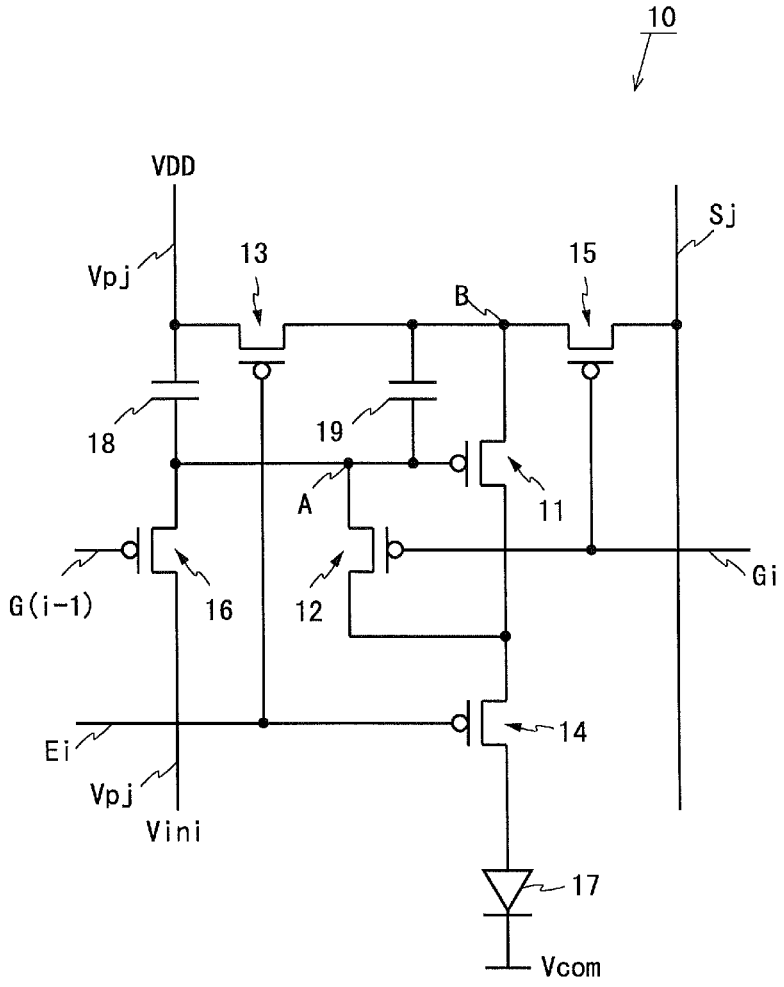
FIG. 2 is a circuit diagram of a pixel circuit in the embodiment.

FIG. 2 is a circuit diagram of the pixel circuit 10. The pixel circuit 10 includes six TFTs 11 to 16, an organic EL element 17, a data holding capacitor 18, and a threshold holding capacitor 19, as shown in FIG. 2. All of the six TFTs 11 to 16 are p-channel transistors. Note that all of them may be n-channel transistors, or p-channel and n-channel transistors may be used in combination depending on the application.

For example, in the case where n-channel transistors are used, similar operations to the above case can be readily realized by inverting, for example, the power supply potential and the level of the control lines, without changing the connection relationships between the TFTs and the capacitors. This will be described below and can be applied similarly to embodiments to be described later, and therefore, the following description will be omitted in the embodiments.

Each of the six TFTs 11 to 16 functions as an initialization control transistor, a write control transistor, a drive transistor, or a light-emission control transistor. Note that the functions listed above are simply major functions, and other functions may be provided. The details of the above functions will be described later. Moreover, the organic EL element 17 functions as an electro-optic element.

Note that in addition to the organic EL element, the term "electro-optic element" herein refers to any element whose optical properties change upon application of electricity, e.g., an FED (field emission display) element, an LED, a charge-driven element, a liquid crystal, or E Ink (Electronic Ink). Moreover, although the following description takes the organic EL element as an example of the electro-optic element, the description can be applied similarly to any light-emitting elements for which the amount of light emission is controlled in accordance with the amount of current.

The pixel circuit 10 is connected to two scanning signal lines $G_i$ and $G_{(i-1)}$, a control line $E_i$, a data line $S_j$, a pair of power lines $VP_j$, and an electrode having a common potential Vcom, as shown in FIG. 2. The TFT 11 has a source terminal connected to one conductive terminal of the TFT 13 and one conductive terminal of the TFT 15, and the TFT 11 also has a drain terminal connected to one conductive terminal of the TFT 12 and one conductive terminal of the TFT 14.

The other conductive terminal of the TFT 13 is connected to one of the power lines $VP_j$, which provides a power supply potential VDD. The other conductive terminal of the TFT 15 is connected to the data line $S_j$. The other conductive terminal of the TFT 14 is connected to an anode terminal of the organic EL element 17.

Furthermore, the aforementioned conductive terminal of the TFT 12 is connected to a gate terminal (control terminal) of the TFT 11, and the other conductive terminal of the TFT 12 is connected to the drain terminal of the TFT 11. Such connections allow the TFT 11 to be diode-connected.

Furthermore, the TFT 16 is connected at one conductive terminal to the other power line $VP_j$, which provides an initialization potential Vini, and at the other conductive terminal to the gate terminal of the TFT 11. The data holding capacitor 18 is also connected at one terminal to the gate terminal of the TFT 11 and at the other terminal to the power line $VP_j$ that provides the power supply potential VDD. Moreover, the threshold holding capacitor 19 is positioned between the source terminal and the gate terminal of the TFT 11. The organic EL element 17 has the common potential Vcom applied at its cathode terminal.

The scanning signal line $G_i$ is connected to a gate terminal (control terminal) of each of the TFTs 12 and 15. The TFTs 12 and 15 function as write control transistors. The scanning signal line $G_{(i-1)}$ is connected to a gate terminal (control terminal) of the TFT 16. The TFT 16 functions as an initialization control transistor. The control line $E_i$ is connected to a gate terminal (control terminal) of each of the TFTs 13 and 14. The TFTs 13 and 14 function as light-emission control transistors.

Figure 3:
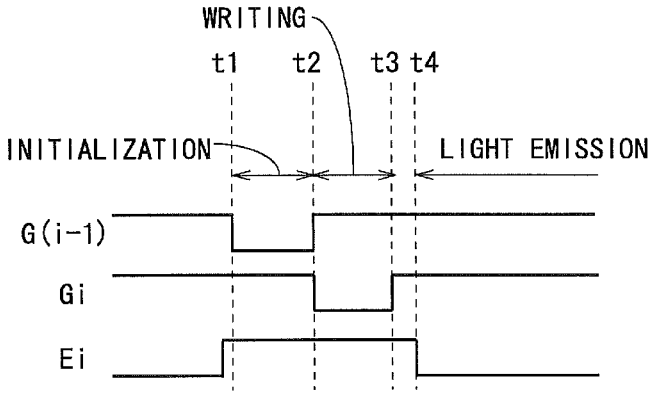
FIG. 3 is a timing chart showing a method for driving the pixel circuit in the embodiment.

FIG. 3 is a timing chart showing a method for driving the pixel circuit 10. Prior to time t1, the potentials of the scanning signal lines $G_{(i-1)}$ and $G_i$ are at high level, i.e., inactive, and the potential of the control line $E_i$ is at low level, i.e., active. In the previous frame, the control line $E_i$ is set to the inactive potential immediately before time t1, so that light emission is stopped, and then at time t1, the scanning signal line $G_{(i-1)}$ is activated, so that the gate terminal of the TFT 11 and the power line $VP_j$ that provides the initialization potential Vini are electrically connected, and the initialization potential Vini is written to one terminal of the data holding capacitor 18 (and the gate terminal of the TFT 11 functioning as a drive transistor). The above operation is referred to as an initialization operation.

At time t2, the scanning signal line $G_{(i-1)}$ is deactivated, and the scanning signal line $G_i$ is activated, so that the TFTs 12 and 15 are turned on. Moreover, the potential of the data line $S_j$ is set to a level that accords with display data. Such a potential will be referred to below as a "data potential Vdata". Accordingly, the potential of node B shown at the source terminal of the TFT 11 changes to Vdata+Vth (where Vth is the threshold voltage of the TFT 11) as a result of the TFT 11 being diode-connected, and the potential of node B is stabilized at that voltage. Note that at this time, the TFT 14 is off, and therefore no current is applied to the organic EL element 17.

At time t3, the scanning signal line $G_i$ is deactivated, so that the TFTs 12 and 15 are turned off, the threshold holding capacitor 19 holds the threshold voltage Vth, and the data holding capacitor 18 holds a voltage having the value (Vdata+Vth−VDD) because its terminal is connected to the power supply potential VDD. The above operation is referred to as a writing operation.

Here, assuming that the capacitance value of the data holding capacitor 18 is c1, and the capacitance value of the threshold holding capacitor 19 is c2, the stored charge Q1 of the data holding capacitor 18 and the stored charge Q2 of the threshold holding capacitor 19 are represented by the following equations (1) and (2), respectively.

$$Q1=c1\times(V\text{data}+Vth-VDD) \quad (1)$$

$$xQ2=c2\times Vth \quad (2)$$

At time t4, the control line $E_i$ is activated, so that the TFTs 13 and 14 are turned on. As a result, a current flows through the organic EL element 17, so that light emission is started. At this time, the potential of node B is set to the power supply potential VDD, and the data holding capacitor 18 and the threshold holding capacitor 19 become equal in the value of their terminal-to-terminal voltages (i.e., the difference in potential between nodes A and B shown in the figure). The voltage will be denoted by Vgs below. After completion of the write period, no charges escape from node A, which is obvious from the connection relationships of the TFTs, and charge redistribution occurs, so that the combined stored charge (Q1+Q2) of the data holding capacitor 18 and the threshold holding capacitor 19 is held. Accordingly, the voltage Vgs can be represented by the following equation (3).

$$\begin{aligned} Vgs &= (c1\times(Vdata+Vth-VDD)+c2\times Vth)/(c1+c2) \\ &= c1/(c1+c2)\times(Vdata-VDD)+Vth \end{aligned} \quad (3)$$

During the light emission period (from time t4) as described above, the power supply potential VDD is set at a value allowing the TFT 11 to operate in the saturation region, and therefore, if the channel-length modulation effect is not taken into consideration, the current I that flows through the TFT 11 during the light emission period can be obtained by the following equation (4).

$$I=\tfrac{1}{2}\cdot W/L\cdot\mu\cdot\text{Cox}(Vgs-Vth)^2 \quad (4).$$

In equation (4), W is the gate width, L is the gate length, μ is the carrier mobility, and Cox is the gate oxide capacitance.

Further, the following equation (5) can be derived from equations (3) and (4).

$$I=\tfrac{1}{2}\cdot W/L\cdot\mu\text{Cox}\cdot K^2\cdot(V\text{data}-VDD)^2 \quad (5)$$

In equation (5), K=c1/(c1+c2).

The current I shown in equation (5) changes in accordance with the data potential Vdata, but does not depend on the threshold voltage Vth of the TFT 11. Accordingly, even in the case where there are variations in the threshold voltage Vth, or the threshold voltage Vth changes over time, it is possible to apply the current to the organic EL element 17 in accordance with the data potential Vdata, thereby allowing the organic EL element 17 to emit light with a desired luminance.

Here, the overdrive voltage Vov of the TFT 11, which is of a p-channel type, is defined as a value obtained by subtracting the threshold voltage Vth from the gate-source voltage Vgs of the TFT 11, and therefore, can be represented by the following equation (6).

$$Vov=Vgs—Vth=c1/(c1+c2)\times(V\text{data}-VDD) \quad (6)$$

Accordingly, as can be appreciated by applying equation (6) to equation (5), the current I flowing through the TFT 11 during the light emission period is proportional to the square of the overdrive voltage Vov. Therefore, application of a current to the organic EL element 17 in accordance with the data potential Vdata will also be described below as application of a current in accordance with the overdrive voltage Vov for the sake of convenience.

In this manner, the current is applied continuously to the organic EL element 17 while the potential of the control line $E_i$ is active, and therefore, the pixel circuits 10 in the i'th row emit light with a luminance in accordance with the data potential provided thereto. At this time, pixel circuits 10 in the (i+1)'th and subsequent rows might be in the middle of the write period. That is, when a pixel circuit is in the middle of the write period, pixel circuits in previous rows are lit up. Accordingly, the power supply potential VDD might experience a voltage drop (i.e., an IR drop), and a change of the power supply potential VDD results in a change of the overdrive voltage Vov, so that the luminance might vary depending on the location of the pixel circuit.

Figure 20:
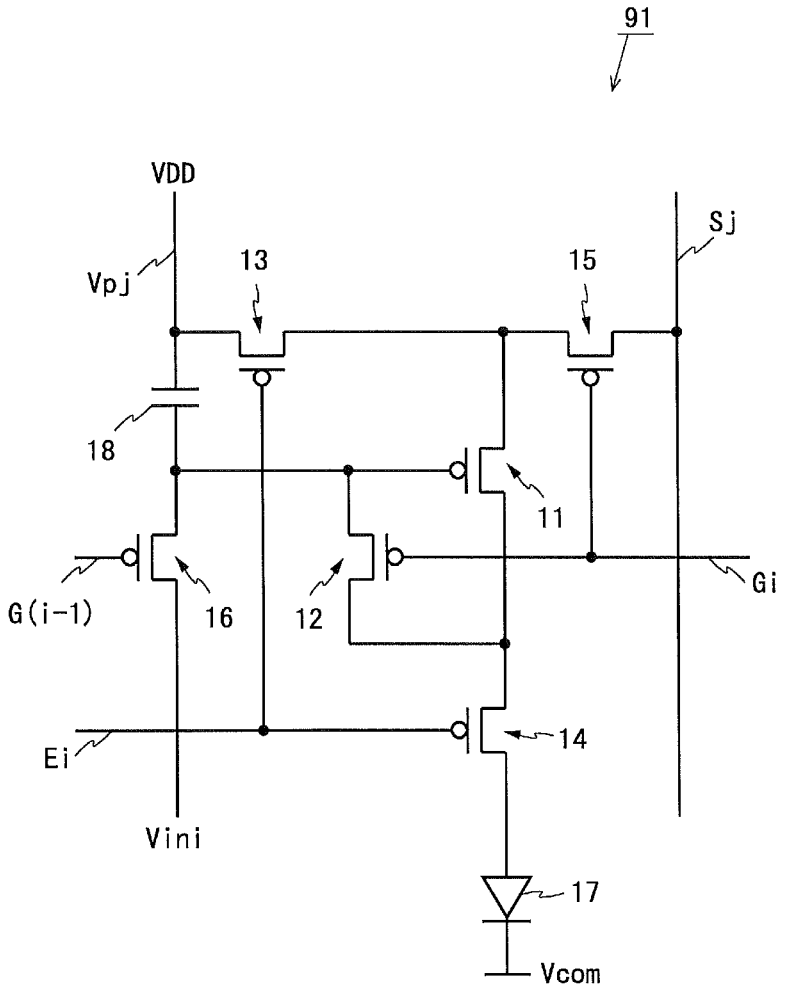
FIG. 20 is a circuit diagram of a pixel circuit 91 included in a conventional display device.

Here, as in the case of the conventional pixel circuit 91 described earlier and shown in FIG. 20, which is not provided with the threshold holding capacitor 19 (hence C2=0), the overdrive voltage Vov of the TFT 11 included in the pixel circuit 91 has the value (Vdata−VDD). Accordingly, when the overdrive voltage Vov of the TFT 11 included in pixel circuit 10 in the present embodiment is compared to the conventional case, the configuration of the present embodiment allows the change of the overdrive voltage Vov resulting from the change of the power supply potential VDD to be suppressed to c1/(c1+c2). As a result, the difference in luminance due to an IR drop caused by the locations of the pixel circuits can be reduced, so that display quality can be inhibited from being reduced.

Furthermore, the charges in the data holding capacitor 18 and the threshold holding capacitor 19 are added during the light emission period, as described above, and therefore, both of them function as storage capacitance. As a result, storage capacitance can be increased without increasing the size of the data holding capacitor 18 more than in the conventional case. Moreover, by setting the combined capacitance value of the data holding capacitor 18 and the threshold holding capacitor 19 so as to be equal to the capacitance value of the conventional data holding capacitor 18, it is rendered possible to create the same storage capacitance with the same area as in the conventional pixel circuit, so that the threshold holding capacitor 19 can be added without increasing the circuit area of the pixel circuit.

Furthermore, the dynamic range (the difference between the maximum and the minimum) of the data potential Vdata required for defining the emission luminance of the organic EL element 17 (proportional to the amount of current) can be decreased by c1/(c1+c2) compared to the conventional dynamic range. For example, in the case where the proportion of c2 to c1 is 1, when the data driver circuit 3 having a dynamic range of 4V is used, the dynamic range of the overdrive voltage Vov applied to the pixel circuit is 2V. Accordingly, even in the case where the dynamic range of, for example, 4V is excessively large for the amount of current to be applied to the organic EL element 17, an appropriate, not excessive, amount of current can be applied to the organic EL element 17 without changing the dynamic range of the data driver circuit 3.

This is effective in practical use; the reason for this is that in the case where a typical data driver circuit 3 is used, the amount of current is often excessive to drive a typical organic EL element, and it is often preferable to control the element with a smaller amount of current.

Furthermore, the error in data potential due to an output deviation of the data driver circuit 3 does not necessarily decrease in proportion as the dynamic range decreases, and in general, the rate of error per grayscale level decreases relatively as the dynamic range increases. Accordingly, by using the (typical) data driver circuit 3 having a large dynamic range, it is possible to further reduce the error in data potential. Thus, it is possible to suppress variations in pixel luminance due to output deviations of the data driver circuit 3.

Furthermore, in a conceivable method for reducing the amount of current for driving the organic EL element while keeping a large dynamic range of the data driver circuit 3, the channel length L of the TFT 11 that drives the organic EL element is increased. However, high-definition display devices with a high aperture ratio are recently required, and therefore, pixel circuits with smaller areas are preferable. Accordingly, it is not preferable to increase the channel length L of the TFT 11. The present embodiment allows the organic EL element to be controlled with a smaller amount of current without changing the size of the TFT 11.

Further, such a change in the configuration of the TFT included in the pixel circuit necessitates mobility adjustments, hence changes in design conditions, production processes, etc. The present embodiment allows use of the TFT 11 having the same configuration as in the conventional embodiment, resulting in higher flexibility of design.

First Variant of the First Embodiment

Next, a variant on the configuration of the pixel circuit 10 shown in FIG. 2 will be described with reference to FIG. 4. A pixel circuit 10*a* shown in FIG. 4 includes six TFTs 11 to 16, an organic EL element 17, a data holding capacitor 18, and a threshold holding capacitor 19, which are the same components as in the pixel circuit 10.

Here, the data holding capacitor 18 is connected at one terminal to the gate terminal of the TFT 11 as in the case shown in FIG. 2, but unlike in the case shown in FIG. 2, the data holding capacitor 18 is connected at the other terminal to the power line $VP_j$ that provides the initialization potential Vini.

Figure 4:
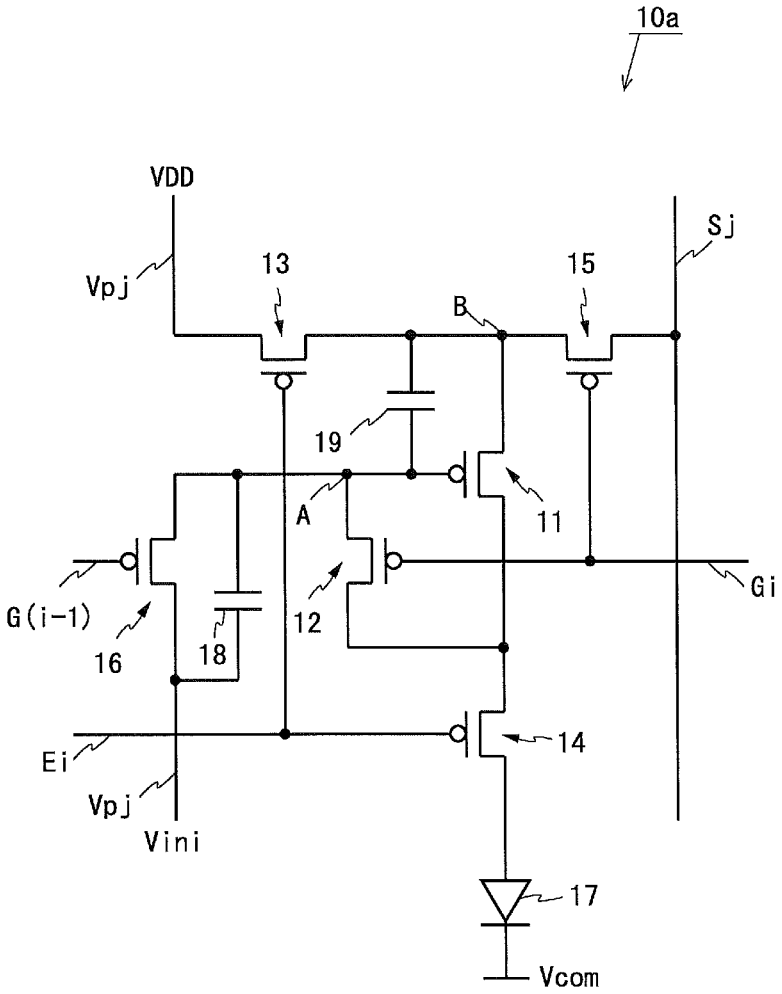
FIG. 4 is a circuit diagram of a pixel circuit in a first variant of the embodiment.

Furthermore, the pixel circuit 10*a* shown in FIG. 4 is driven in the same mode as the pixel circuit 10 in the first embodiment, but since the data holding capacitor 18 is connected at the terminal to the initialization potential Vini, rather than the power supply potential VDD, the voltage (Vdata+Vth−Vini) is held during the write period.

Therefore, unlike in the first embodiment, the potential at the gate terminal of the TFT 11 is not affected by a change of the power supply potential VDD. Accordingly, the luminance of a pixel circuit is not affected by a drop of the power supply potential VDD (an IR drop) due to other pixel circuits being lit up. Thus, higher-quality display can be provided. Note that in the case where a constant potential other than the initialization potential Vini can be provided, such a constant potential may be used in place of the initialization potential Vini.

Figure 24:
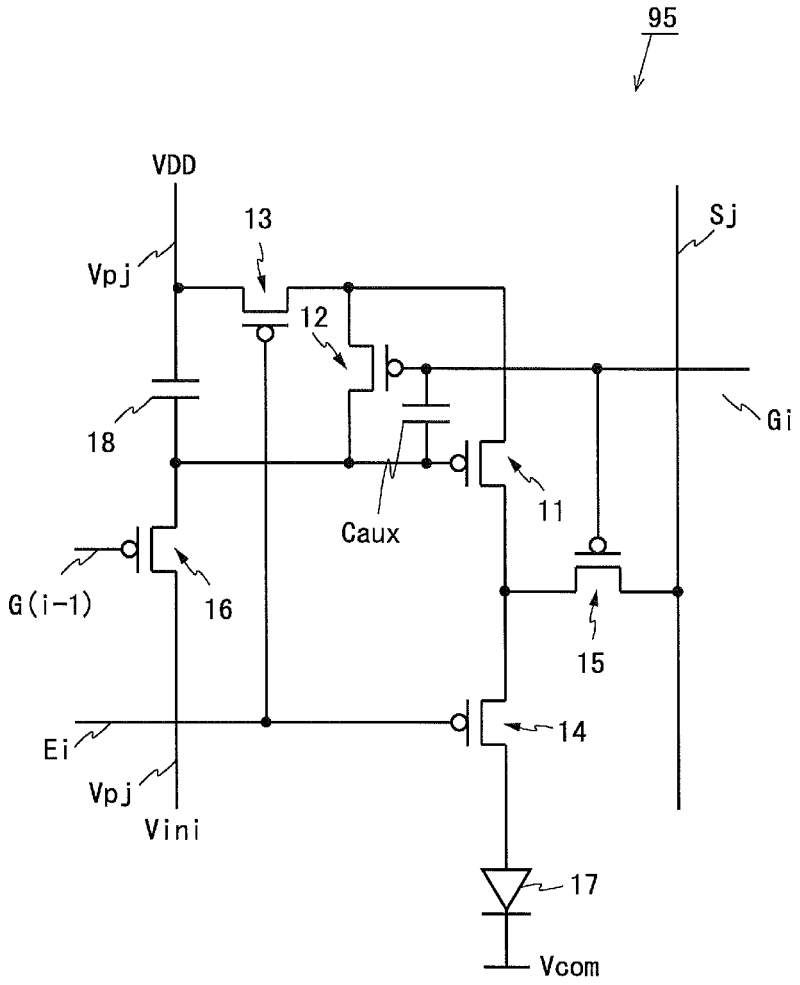
FIG. 24 is a circuit diagram of a pixel circuit 95 included in a conventional display device.

In this manner, the data potential cannot be held if the data holding capacitor 18 is connected at the terminal to a constant-potential point. The same can be said of the threshold holding capacitor 19, as will be described later, and in this regard, the threshold holding capacitor 19 differs in function from the auxiliary capacitor Caux of the pixel circuit 95 described in Japanese Laid-Open Patent Publication No. 2007-79580 and shown in FIG. 24. As shown in FIG. 24, the auxiliary capacitor Caux, as with the capacitor 18, is connected at one terminal to the control terminal of the TFT 11, but the other terminal thereof is connected to the scanning signal line $G_i$, the potential of which is variable. Accordingly, the auxiliary capacitor Caux completely differs in function from the threshold capacitor 19, and does not achieve the same effect as that achieved by the threshold capacitor 19.

Second Variant of the First Embodiment

In the first embodiment, all pixel circuits 10 are provided with respective threshold holding capacitors 19, but only the pixel circuits for emitting red (R) as shown in FIG. 1 may be provided with threshold holding capacitors 19, i.e., the pixel circuits for emitting either green (G) or blue (B) are not provided with threshold holding capacitors 19.

In this case, only the pixel circuits for emitting red (R) achieve the same effect as in the first embodiment, and such an effect does not reach the pixel circuits for emitting either green (G) or blue (B). The reason that this configuration has the effect on the entire display device is because the red-emitting organic EL elements of the pixel circuits for emitting red (R) generally have high luminous efficiency.

Specifically, the red luminescent material for organic EL elements currently in general use has higher luminous efficiency than the green and blue luminescent materials, and therefore, upon application of a large current, the emission luminance of the red luminescent material becomes higher than that of the luminescent materials for the other colors, so that the white balance (color balance) of a display image becomes abnormal. Therefore, the threshold holding capacitor 19 is provided in the pixel circuit for emitting red (R), such that a more appropriate current, i.e., a microcurrent, flows, thereby consequently decreasing the dynamic range of the voltage provided to the gate terminal of the drive transistor by c1/(c1+c2). Thus, it is possible to provide an appropriate, not excessive, amount of current to the red-emitting organic EL element 17 without changing the dynamic range of the data driver circuit 3 itself (for each color).

Furthermore, the green luminescent material for organic EL elements currently in general use has higher luminous efficiency than the blue luminescent material. Accordingly, similar to the above, it is conceivable to provide the threshold holding capacitor 19 not only in the pixel circuit for emitting red (R) but also in the pixel circuit for emitting green (G), such that a weaker current flows, thereby consequently decreasing the dynamic range by c1/(c1+c2). With this configuration also, it is possible to provide an appropriate, not excessive, amount of current to both the red-emitting organic EL element 17 and the green-emitting organic EL element 17 without changing the dynamic range of the data driver circuit 3 itself (for each color).

In addition, the blue luminescent material for organic EL elements currently in general use has the lowest luminous efficiency of all of the colors, but similar to the above, the threshold holding capacitor 19 may also be provided in the pixel circuit for emitting blue (B) either when the dynamic range of the typical data driver circuit 3 is excessively large or in order to reduce the influence of a decrease in the power supply potential (due to an IR drop).

Here, by suitably adjusting the value c1/(c1+c2) of the pixel circuit for each color, the need to change the dynamic range of the data driver circuit 3 for each color can be eliminated. In such a case, among the pixel circuits for all of the colors, the pixel circuit for emitting red (R) has the lowest ratio (c1/c2) of the threshold holding capacitor 19 to the data holding capacitor 18, and the pixel circuit for emitting blue (B) has the highest ratio.

Furthermore, setting the ratio can be facilitated by allowing the pixel circuit for emitting blue (B) to have the highest ratio among the pixel circuits for all of the colors, i.e., typically by not providing the threshold holding capacitor 19 in the pixel circuit for emitting blue (B) (hence c2=0). This will be described below using specific numerical values with reference to FIG. 5.

Figure 5:
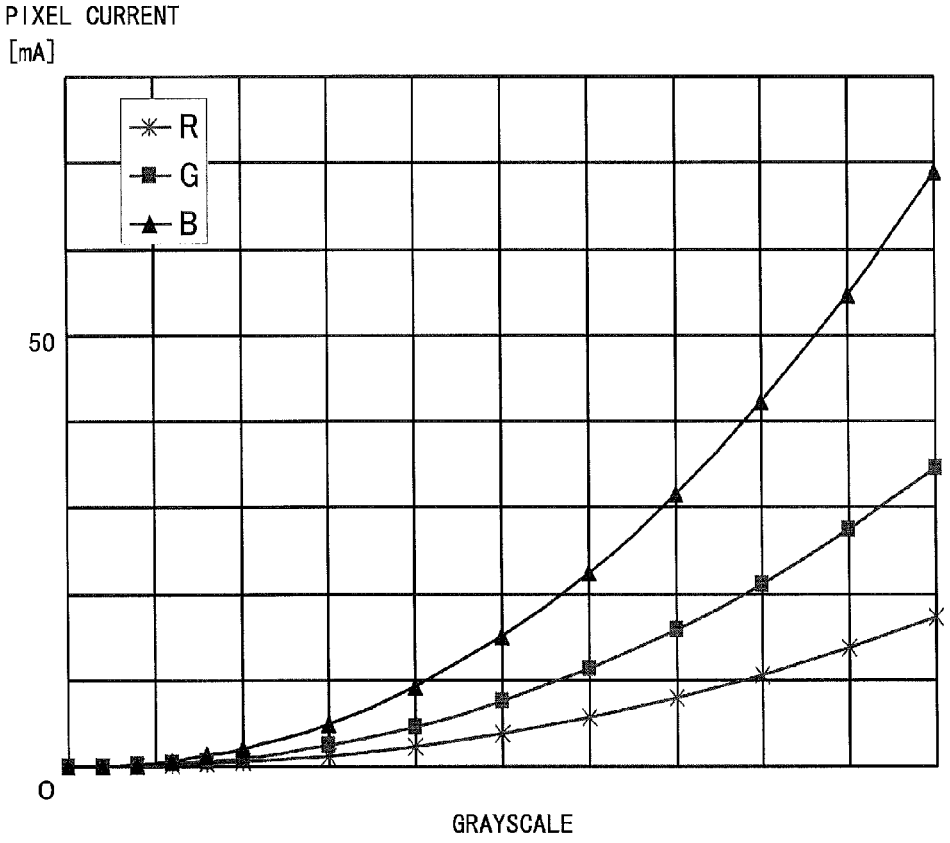
FIG. 5 is a graph showing the relationship between pixel currents flowing through various pixel circuits for emitting respective colors and the grayscale level in a second variant of the embodiment.

FIG. 5 is a graph showing the preferred relationship between the pixel current and the grayscale level of the pixel circuit for each color. In the state shown in FIG. 5, the emission luminance of the pixel circuit is adjusted suitably for each color, resulting in a good white balance. The ratio of pixel current among the colors in such a case can be represented by the following equation (7).

$$R:G:B=1:2:4 \tag{7}$$

Here, assuming that the grayscale voltage amplitude, which is a voltage range from the minimum to maximum grayscale level, is 4V where it corresponds to the dynamic range of the pixel circuit for emitting blue (B), it can be appreciated with reference to equation (5) that the grayscale voltage amplitude is about 2.8V for the pixel circuit for emitting blue (B), and also 2V for the pixel circuit for emitting red (R). Assuming that the capacitance of the data holding capacitor 18 in the pixel circuit is 1 for all of the colors where the threshold holding capacitor 19 is not provided in the pixel circuit for emitting blue (B) (i.e., c2=0), in order to achieve the aforementioned ratio among the pixel circuits for the colors where such dynamic ranges as those mentioned above are realized, the capacitance of the data holding capacitor 18 may be set at 1 for the pixel circuit for emitting red (R) and also about 0.41 for the pixel circuit for emitting green (G). This makes it easy to suitably set the pixel current of the pixel circuit for each color while fixing the grayscale voltage amplitude at 4V for all of the pixel circuits, i.e., without changing the dynamic range of the data driver circuit 3 from 4V.

Furthermore, it is conceivable to set the combined capacitance value (c1+c2) of the data holding capacitor 18 and the threshold holding capacitor 19 in the pixel circuit for each color either while maintaining the aforementioned ratio or without taking the ratio into consideration, in a manner as will be described below.

First, it is conceivable to equalize the pixel circuits for all of the colors in terms of the combined capacitance value (c1+c2). This allows the dynamic range to be set freely while keeping the same layout area to be occupied by the capacitance element in each pixel circuit.

Furthermore, it is conceivable to set the combined capacitance value (c1+c2) of the pixel circuit for red (R) lower than that of the pixel circuit for green (G), which is set lower than the combined capacitance value (c1+c2) of the pixel circuit for blue (B). In general, among the organic EL elements used in the pixel circuits for all of the colors, the element for blue (B) has the shortest service life, and the element for red (R) has the longest service life. Accordingly, to make the service life of an organic EL element last long, it is preferable to reduce the density of current flowing therethrough, and to this end, it is preferable to increase the layout area for that element, i.e., the portion that emits light (that is, it is preferable to increase the aperture ratio). Therefore, the combined capacitance value is set as described above, whereby the layout area occupied by the capacitance element increases as the service life of the organic EL element included in the pixel circuit becomes shorter, so that the layout area for the light-emitting portion can be increased.

Given the aforementioned ratio, it is conceivable to set the combined capacitance value (c1+c2) of the pixel circuit for red (R) higher than that of the pixel circuit for green (G), which is set higher than the combined capacitance value (c1+c2) of the pixel circuit for blue (B). Such settings render it possible to prevent deviations of grayscale levels and occurrence of flicker. Specifically, when the capacitance of the data holding capacitor 18 and the threshold holding capacitor 19 is set such that the dynamic range is taken into consideration in the ratio between their capacitance values in a manner as described above, the pixel circuit for red (R) has the lowest charge held in the capacitors during the light emission period, and the pixel circuit for blue (B) has the highest charge. As the held charge decreases, the influence on the held charge by leakage currents in the TFTs 12 and 16 increases, which might result in display grayscale error, flicker, etc. Therefore, the combined capacitance value (c1+c2) of the pixel circuit is set for each color in the above manner, thereby eliminating or reducing the aforementioned influence on the pixel circuits for red (R) and green (G), which respectively have the highest and the second highest charge held in the capacitors.

The primary colors displayed by the pixel circuits have been described above as being red (R), green (G), and blue (B), but other primary colors may be displayed. Moreover, the aforementioned ratio or combined capacitance has been described above on the premise that the organic EL element that emits red light has the highest efficiency and the organic EL element that emits blue light has the lowest efficiency, but in the case where the efficiency, characteristics, etc., of the organic EL elements for the colors change as a result of, for example, development of a new material, the primary colors may be changed suitably depending on the details of such changes.

Furthermore, the pixel circuits may include those that emit white (W) in addition to red (R), green (G), and blue (B). It is often the case that when such a pixel configuration is employed, all pixel circuits typically include white light-emitting elements, and color filters for emitting the colors R, G, and B are provided. In such a configuration, only the pixel circuit for white (W) is not provided with a color filter, and therefore, the luminous efficiency thereof is the highest. Accordingly, it is preferable that the aforementioned ratio of the pixel circuit for white (W) be set lower than that of another pixel circuit (e.g., the pixel circuit for red). As a result, it is possible to readily set a suitable pixel current of the pixel circuit for each color without changing the dynamic range of the data driver circuit 3.

Still further, the pixel circuits may include those that emit yellow (Y) in addition to red (R), green (G), and blue (B). Currently, the luminous efficiency of the organic EL element for emitting yellow (Y) is similar to that of the organic EL element for emitting green (G). Accordingly, the aforementioned ratio of the organic EL element for emitting yellow (Y) is set higher than that of the pixel circuit for emitting red (R) but lower than that of the pixel circuit for emitting blue (R). As a result, it is possible to readily set a suitable pixel current of the pixel circuit for each color without changing the dynamic range of the data driver circuit 3. While the foregoing has been given as a variant of the first embodiment, similar effects can be achieved by similar configurations in other embodiments and variants thereof.

Second Embodiment

Figure 6:
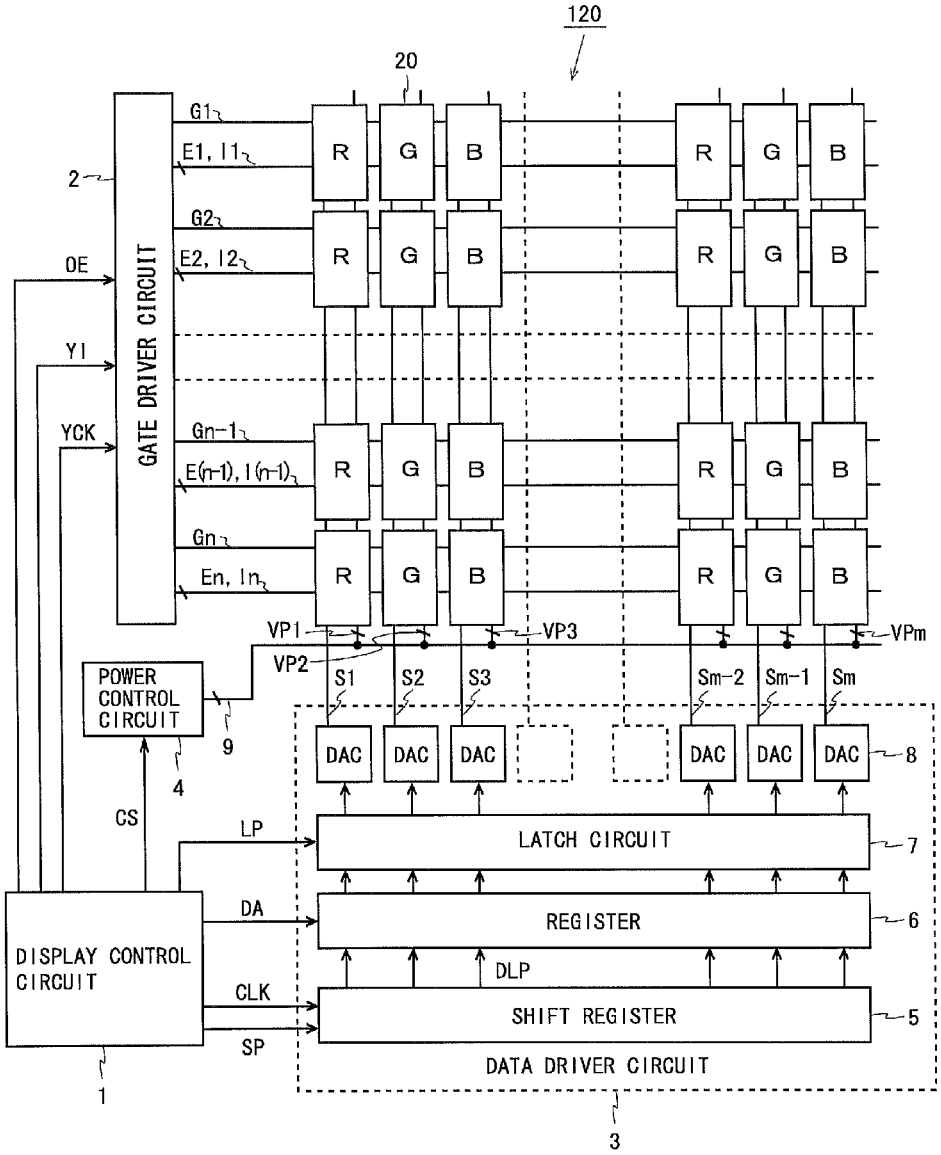
FIG. 6 is a block diagram illustrating the configuration of a display device according to a second embodiment of the present invention.

FIG. 6 is a block diagram illustrating the configuration of a display device according to a second embodiment of the present invention. The display device 120 shown in FIG. 6 has approximately the same configuration as the display device 110 shown in FIG. 1, but the pixel circuit 20 differs in configuration from the pixel circuit 10, and there is a difference in that n initialization control lines $I_i$ are provided parallel to the n control lines $E_i$. The initialization control lines $I_i$ are provided with initialization signals outputted by the gate driver circuit 2.

Figure 7:
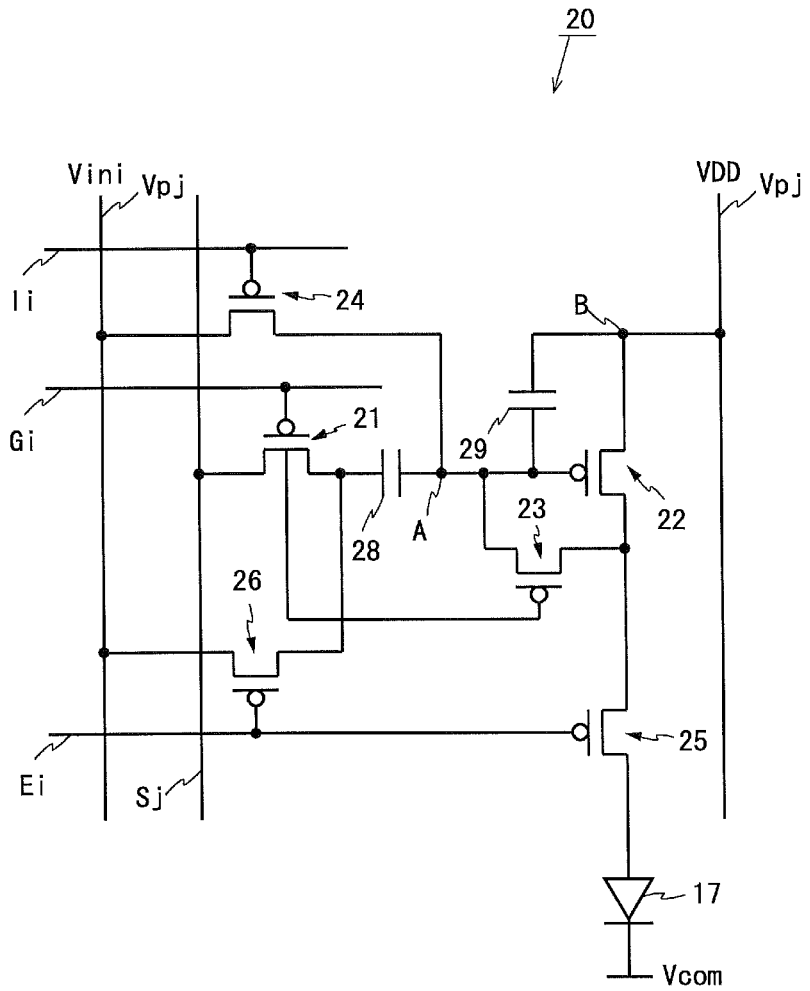
FIG. 7 is a circuit diagram of a pixel circuit in the embodiment.

FIG. 7 is a circuit diagram of the pixel circuit 20. The pixel circuit 20 includes six TFTs 21 to 26, an organic EL element 17, a data holding capacitor 28, and a threshold holding capacitor 29, as shown in FIG. 7. All of the six TFTs 21 to 26 are p-channel transistors. Note that all of them may be n-channel transistors, or p-channel and n-channel transistors may be used in combination depending on the application.

The pixel circuit 20 is connected to a scanning signal line $G_i$, a control line $E_i$, an initialization control line $I_i$, a data line $S_j$, a pair of power lines $VP_j$, and an electrode having a common potential Vcom, as shown in FIG. 7. The TFT 22 has a source terminal connected to the power line $VP_j$ that provides a power supply potential VDD and a drain terminal connected to one conductive terminal of the TFT 23. The other conductive terminal of the TFT 23 is connected to a gate terminal of the TFT 22. Such connections allow the TFT 22 to be diode-connected.

Furthermore, the TFT 25 is connected at one conductive terminal to the drain terminal of the TFT 22 and at the other conductive terminal to an anode terminal of the organic EL element 17.

Furthermore, the TFT 21 is connected at one conductive terminal to the data line $S_j$ and at the other conductive terminal to one terminal of the data holding capacitor 28. Both of the TFTs 24 and 26 are connected at one conductive terminal to the power line $VP_j$ that provides an initialization potential Vini. The TFT 24 is connected at the other conductive terminal to the other terminal of the data holding capacitor 28, and the TFT 26 is connected at the other conductive terminal to the opposite terminal of the data holding capacitor 28.

The data holding capacitor 28 is connected at the other terminal to the gate terminal of the TFT 22. Moreover, the threshold holding capacitor 29 is positioned between the source and gate terminals of the TFT 22. The organic EL element 17 has the common potential Vcom applied at its cathode terminal.

The scanning signal line $G_i$ is connected to a gate terminal of each of the TFTs 21 and 23. The TFTs 21 and 23 function as write control transistors. The initialization control line $I_i$ is connected to a gate terminal of the TFT 24. The TFT 24 functions as an initialization control transistor. The control line $E_i$ is connected to a gate terminal of each of the TFTs 25 and 26. The TFTs 25 and 26 function as light-emission control transistors. Moreover, the TFT 26 provides a constant potential, such as the initialization potential Vini (or the power supply potential VDD as described above), to the terminal of the data holding capacitor 28 during light emission, and therefore, also functions as a constant-potential supply transistor.

Figure 8:
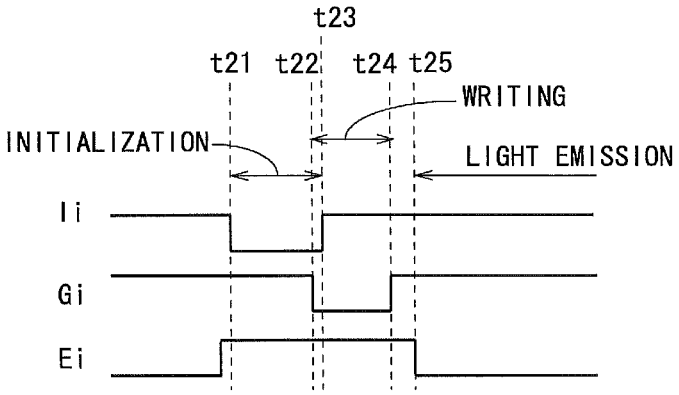
FIG. 8 is a timing chart showing a method for driving the pixel circuit in the embodiment.

FIG. 8 is a timing chart showing a method for driving the pixel circuit 20. The waveforms shown in FIG. 8 for the potentials of the scanning signal line $G_i$ and the control line $E_i$ are the same as those shown in FIG. 3, but the waveform showing a change of the potential of the initialization control line $I_i$ slightly differs from the waveform showing a change of the potential of the scanning signal line $G_{(i-1)}$.

More specifically, at time t22, the scanning signal line $G_i$ is activated, and the initialization control line $I_i$ is kept active, though the scanning signal line $G_{(i-1)}$ is deactivated. Accordingly, once the initialization control line $I_i$ is activated at time t21, the gate terminal of the TFT 22 and the power line $VP_j$ that provides the initialization potential Vini are electrically connected, so that the initialization potential Vini is written to the data holding capacitor 28 (an initialization operation), and thereafter, the initialization operation is still continued at time t22. Note that the initialization potential Vini is assumed to be a voltage lower than VDD+Vth but at a sufficient level to turn on the TFT 22.

In this manner, the scanning signal line $G_i$ is activated at time t22 during the initialization operation, so that the TFTs 21 and 23 are turned on, whereby it is ensured that the initialization potential Vini is written to the data holding capacitor 28. This process is the same as conventional, but in the present embodiment, it can be performed in a different manner from the conventional manner.

Figure 21:
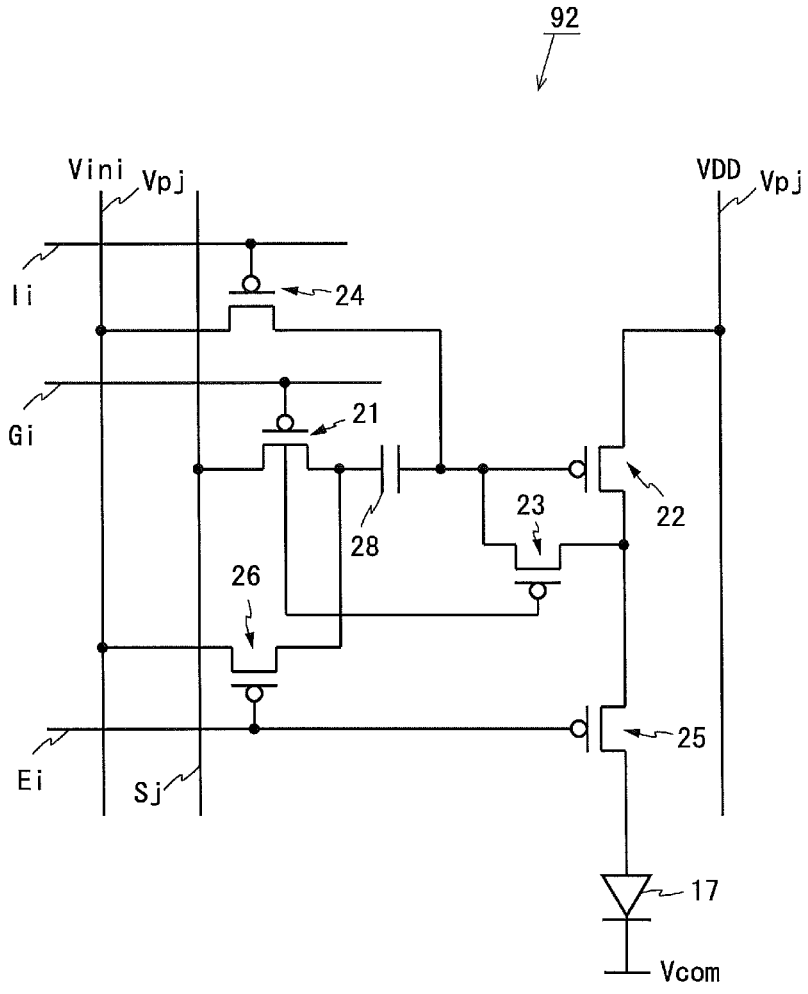
FIG. 21 is a circuit diagram of a pixel circuit 92 included in a conventional display device.
Figure 22:
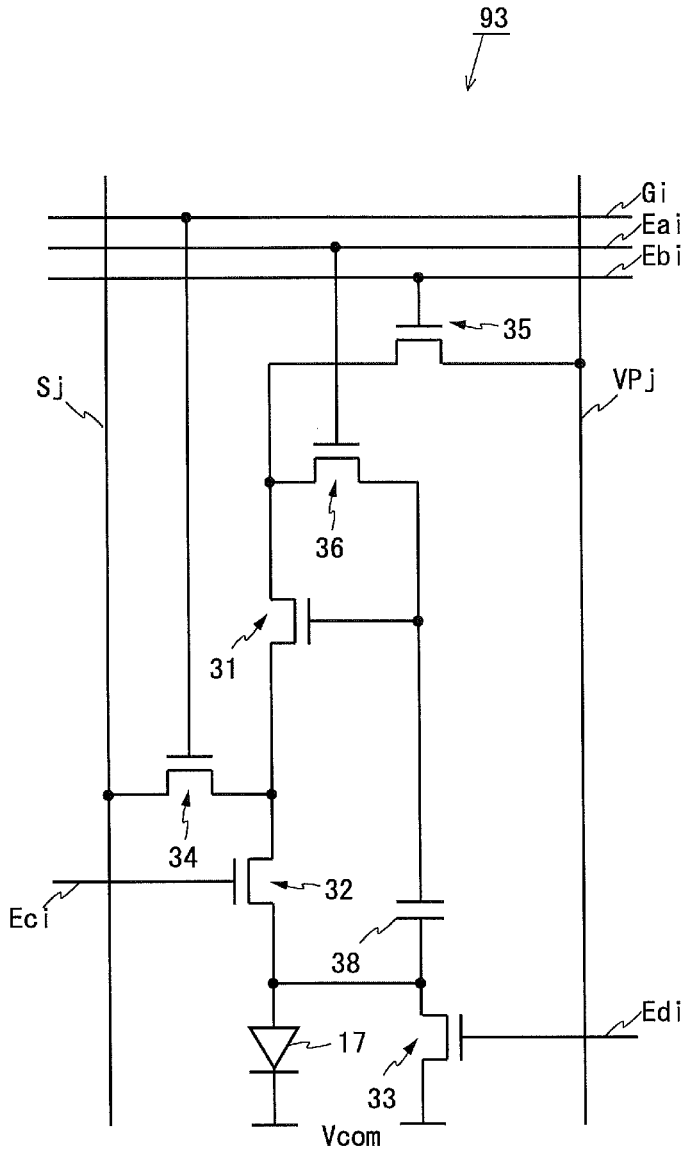
FIG. 22 is a circuit diagram of a pixel circuit 93 included in a conventional display device.
Figure 23:
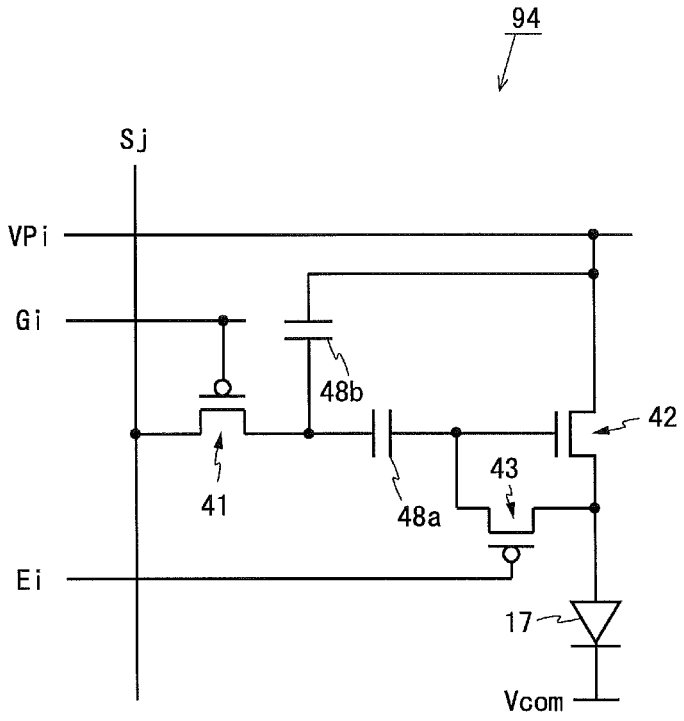
FIG. 23 is a circuit diagram of a pixel circuit 94 included in a conventional display device.

More specifically, the pixel circuit of the present embodiment can be driven (with the waveforms shown in FIG. 3) using the scanning signal line $G_{(i-1)}$ completely in the same manner as in the first embodiment, instead of using the initialization control line $I_i$ of the present embodiment. The conventional pixel circuit shown in FIG. 21 is not provided with the threshold holding capacitor 29, and therefore, it is necessary to drive the pixel circuit in the above manner, thereby ensuring that the initialization potential *Vini* is written to the data holding capacitor 28. However, in the present embodiment, the threshold holding capacitor 29 is provided so that charging to the initialization potential Vini is possible. Thus, it is possible to reliably write the initialization potential Vini to the data holding capacitor 28. In the present embodiment also, employing the drive as above allows the initialization control line $I_i$ to be omitted, so that the configuration of the pixel circuit can be simplified, making it possible to increase the aperture ratio.

Thereafter, at time t23, the initialization control line $I_i$ is deactivated, so that as in the first embodiment, the potential of node B changes to Vdata+Vth (where Vth is the threshold voltage of the TFT 22) as a result of the TFT 22 being diode-connected, and the potential of node B is stabilized at that voltage. Note that at this time, the TFT 25 is off, and therefore no current is applied to the organic EL element 17.

Here, assuming that the capacitance value of the data holding capacitor 28 is c1, and the capacitance value of the threshold holding capacitor 29 is c2, the stored charge Q1 of the data holding capacitor 28 and the stored charge Q2 of the threshold holding capacitor 29 can be represented by the following equations (8) and (9), respectively.

$$Q1=c1\times(VDD+Vth-V\text{data}) \tag{8}$$

$$Q2=c2\times Vth \tag{9}$$

Once the control line $E_i$ is activated at time t25, the TFTs 25 and 26 are turned on. As a result, a current is applied to the organic EL element 17, so that the organic EL element 17 starts emitting light. Here, no charges escape from node A, as described earlier, and therefore, the combined stored charge (Q1+Q2) of the data holding capacitor 18 and the threshold holding capacitor 19 is the same between the time of writing and the time of light emission. Accordingly, assuming that the potential of node A (the gate potential of the TFT 22) is Vx, the equality as shown in the following equation (10) is established.

$$Q1 + Q2 = (c1 \times (VDD + Vth - Vdata) + c2 \times Vth) \quad (10)$$
$$= (c1 \times (Vx - Vini) + c2 \times (Vx - VDD)$$

Solving equation (10) in terms of Vx results in the following equation (11).

$$Vx = -c1/(c1+c2) \times (V\text{data} - V\text{ini}) + VDD + Vth \quad (11)$$

Furthermore, the overdrive voltage Vov of the TFT 22 can be defined as a value obtained by subtracting the threshold voltage Vth from the gate-source voltage Vgs of the TFT 22, and therefore, can be represented by the following equation (12) based on equation (11).

$$Vov = Vgs - Vth \quad (12)$$
$$= Vx - VDD - Vth$$
$$= -c1/(c1 + c2) \times (Vdata - Vini)$$

Accordingly, as can be appreciated with reference to equation (12), the current flowing through the organic EL element is not affected by variations in the threshold voltage Vth and even by changes of the power supply potential VDD, as in the first embodiment.

Furthermore, in the case where the power supply potential VDD fluctuates during the light emission period, the gate potential Vx of the TFT 22 changes so as to follow the changes of the power supply potential VDD, as can be appreciated with reference to equation (11). Therefore, during the light emission period, the emission luminance decreases with the power supply potential VDD, and the smaller the capacitance value c1 of the data holding capacitor 28 is than the capacitance value c2 of the threshold holding capacitor 29, the closer the potentials are in terms of the amount of change (the more readily the changes can be followed). In this manner, the difference in luminance due to an IR drop caused by the locations of the pixel circuits can be reduced significantly, so that reduction in display quality can be suppressed sufficiently.

In this manner, when compared to the first embodiment, the configuration of the present embodiment renders it possible to further reduce the difference in luminance due to an IR drop caused by the locations of the pixel circuits, thereby suppressing reduction in display quality.

Furthermore, in spite of the threshold holding capacitor 29 being provided additionally, it is still possible to keep the circuit area of the pixel circuit from becoming larger than conventional, as in the first embodiment. Moreover, it is possible to provide an appropriate, not excessive, amount of current to the organic EL element 17 without changing the dynamic range of the data driver circuit 3. In addition, by using the (typical) data driver circuit 3 having a large dynamic range, it is rendered possible to further reduce the error in data potential and thereby suppress variations in pixel luminance due to output deviation of the data driver circuit 3. Further, it is possible to control the organic EL element with a smaller amount of current without changing the size of the TFT 22, which does not involve the need to change design conditions, production processes, etc., resulting in higher flexibility of design. Still further, employing the same drive as in the first embodiment allows the initialization control line $I_i$ to be omitted, so that the configuration of the pixel circuit can be simplified, making it possible to increase the aperture ratio.

First Variant of the Second Embodiment

Figure 9:
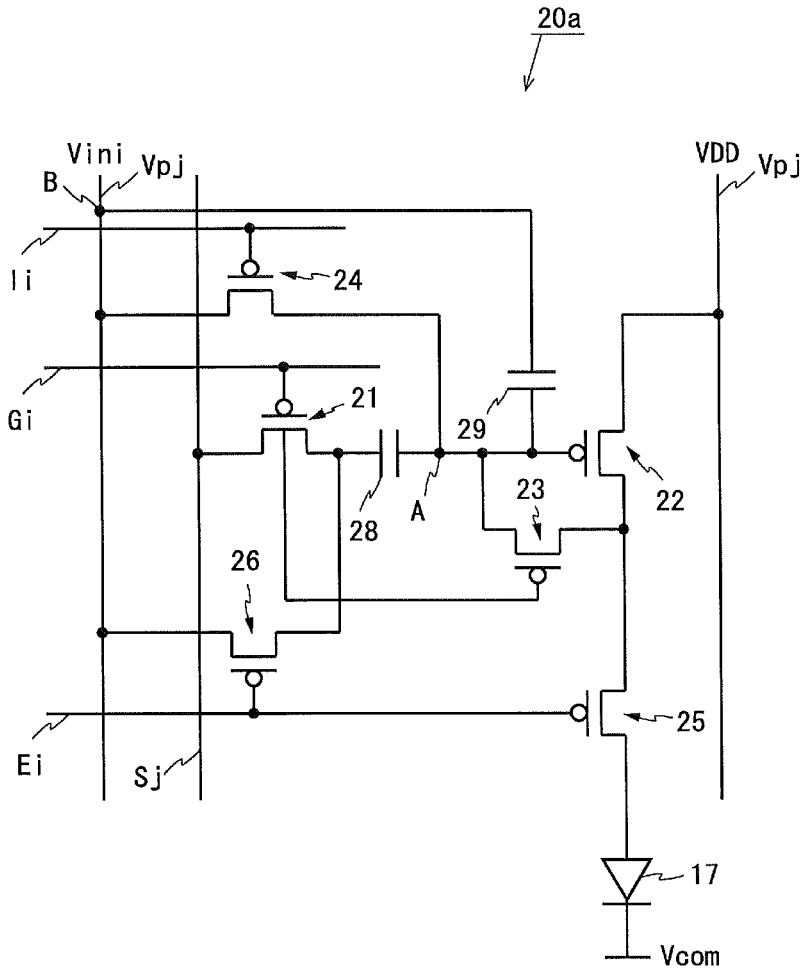
FIG. 9 is a circuit diagram of a pixel circuit in a first variant of the embodiment.

Next, a first variant on the configuration of the pixel circuit 20 shown in FIG. 7 will be described with reference to FIG. 9. A pixel circuit 20*a* shown in FIG. 9 includes six TFTs 21 to 26, an organic EL element 17, a data holding capacitor 28, and a threshold holding capacitor 29, which are the same components as in the pixel circuit 10.

Here, the threshold holding capacitor 29 is connected at one terminal to the gate terminal of the TFT 22 as in the case shown in FIG. 7, but unlike in the case shown in FIG. 7, the threshold holding capacitor 29 is connected at the other terminal to the power line $VP_j$ that provides the initialization potential Vini. Note that in the case where a constant potential other than the initialization potential Vini can be provided, such a constant potential may be used in place of the initialization potential Vini.

The potential cannot be held unless the threshold holding capacitor 29 is connected at the terminal to a constant-potential point in the above manner. Accordingly, the threshold holding capacitor 29 differs in function from the auxiliary capacitor Caux, which is included in the pixel circuit 95 shown in FIG. 24 and connected to the scanning signal line $G_i$, the potential thereof is variable, as described earlier, and the auxiliary capacitor Caux does not achieve the same effect as that achieved by the threshold holding capacitor 29.

Here, the potential being held in the data holding capacitor 28 during the write operation is the same as in the second embodiment, but the potential being held in the threshold holding capacitor 29 is (VDD+Vth−Vini), which is different compared to the second embodiment. Accordingly, the stored charge Q1 of the data holding capacitor 28 and the stored charge Q2 of the threshold holding capacitor 29 can be represented by the following equations (13) and (14), respectively.

$$Q1 = c1 \times (VDD + Vth - V\text{data}) \quad (13)$$

$$Q2 = c2 \times (VDD + Vth - V\text{ini}) \quad (14)$$

Therefore, the potential Vx of node A (the gate potential of the TFT 22) can be represented by the following equation (15) based on equation (11).

$$Vx = -c2/(c1+c2) \times V\text{ini} - c1/(c1+c2) \times V\text{data} + Vth \quad (15)$$

Furthermore, the overdrive voltage Vov of the TFT 22 can be represented by the following equation (16) based on equation (15).

$$Vov = -c2/(c1+c2) \times V\text{ini} - c1/(c1+c2) \times V\text{data} \quad (16)$$

Accordingly, as can be appreciated with reference to equation (16), the current flowing through the organic EL element is not affected by variations in the threshold voltage Vth and is not affected at all even by changes of the power supply potential VDD both at the time of writing and at the time of light emission, as in the first embodiment. Therefore, the difference in luminance due to an IR drop at the time of writing can be eliminated completely. In this manner, the difference in luminance due to an IR drop caused by the locations of the pixel circuits can be significantly reduced, so that reduction in display quality can be sufficiently suppressed.

However, in the case where the power supply potential VDD fluctuates during the light emission period, the gate potential Vx of the TFT 22 does not follow the changes of the power supply potential VDD at all. Accordingly, during the light emission period, the emission luminance decreases with the power supply potential VDD, resulting in a luminance difference due to an IR drop. In this regard, the configuration of the second embodiment is preferable.

Second Variant of the Second Embodiment

Next, a second variant on the configuration of the pixel circuit 20 shown in FIG. 7 will be described with reference to FIG. 10. A pixel circuit 20*b* shown in FIG. 10 includes six TFTs 21 to 26, an organic EL element 17, a data holding capacitor 28, and a threshold holding capacitor 29, which are the same components as in the pixel circuit 20.

Here, unlike in the second embodiment, the TFT 26 is connected at one conductive terminal to the power line $VP_j$ that provides the power supply potential VDD, though the other conductive terminal of the TFT 26 is connected to one terminal of the data holding capacitor 28, as in the second embodiment shown in FIG. 7.

Figure 10:
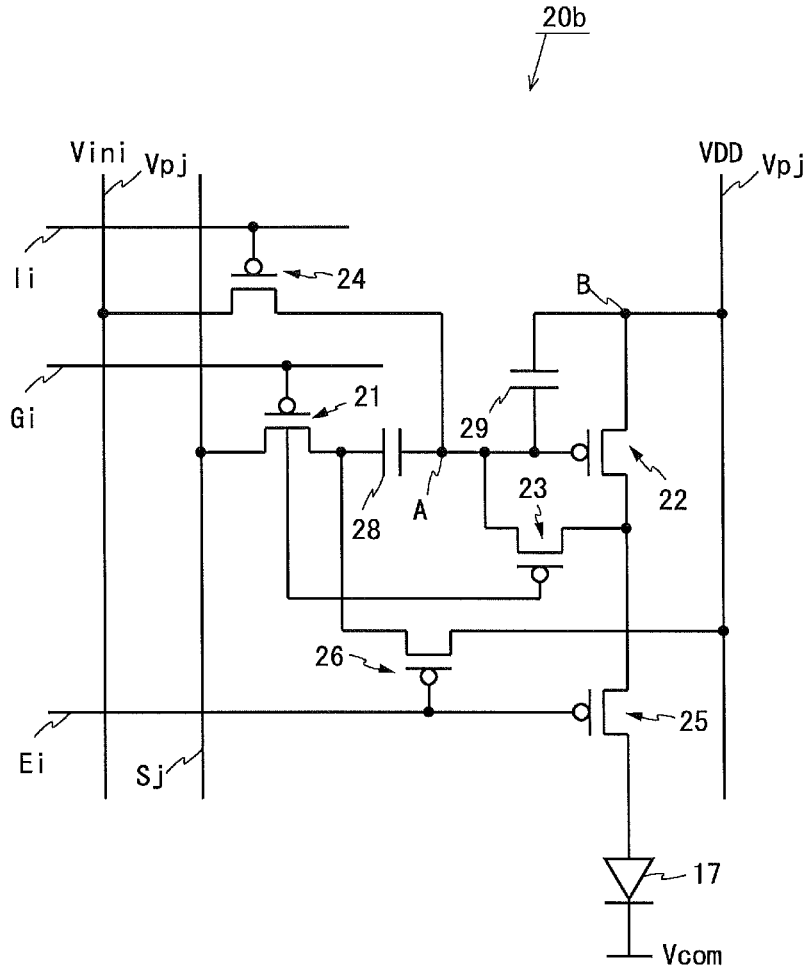
FIG. 10 is a circuit diagram of a pixel circuit in a second variant of the embodiment.

Here, the potentials being held in the data holding capacitor 28 and the threshold holding capacitor 29 during the write operation are the same as those given by equations (8) and (9) (in the second embodiment), but as can be appreciated with reference to FIG. 10, a different voltage is applied at one terminal of the data holding capacitor 18 at the time of light emission. Moreover, the combined stored charge (Q1+Q2) of the data holding capacitor 18 and the threshold holding capacitor 19 is the same between the time of writing and the time of light emission, so that charge redistribution occurs, and therefore, the equality as shown in the following equation (17) is established.

$$Q1 + Q2 = (c1 \times (VDD + Vth - Vdata) + c2 \times Vth) \quad (17)$$
$$= (c1 \times (Vx - VDD) + c2 \times (Vx - VDD)$$

Solving equation (17) in terms of Vx results in the following equation (18).

$$Vx = c1/(c1+c2) \times V\text{data} + (2 \times c1 + c2)/(c1+c2) \times VDD + Vth \quad (18)$$

Furthermore, the overdrive voltage Vov of the TFT 22 can be represented by the following equation (19) based on equation (18).

$$Vov = -c1/(c1 + c2) \times Vdata + c1/(c1 + c2) \times VDD \quad (19)$$
$$= c1/(c1 + c2) \times (VDD - Vdata)$$

Accordingly, as can be appreciated with reference to equation (19), the current flowing through the organic EL element is not affected by variations in the threshold voltage Vth and is not affected at all even by changes of the power supply potential VDD at the time of writing, as in the first embodiment.

Furthermore, in the case where the power supply potential VDD fluctuates during the light emission period, the gate potential Vx of the TFT 22 changes so as to completely follow the changes of the power supply potential VDD. Therefore, during the light emission period, the emission luminance also is not affected by the changes of the power supply potential VDD at all.

Therefore, it is possible to completely eliminate the difference in luminance due to an IR drop both at the time of writing and at the time of light emission. In this manner, the difference in luminance due to an IR drop caused by the locations of the pixel circuits can be completely eliminated, so that the problem with reduction in display quality due to an IR drop can be completely solved.

Third Embodiment

Figure 11:
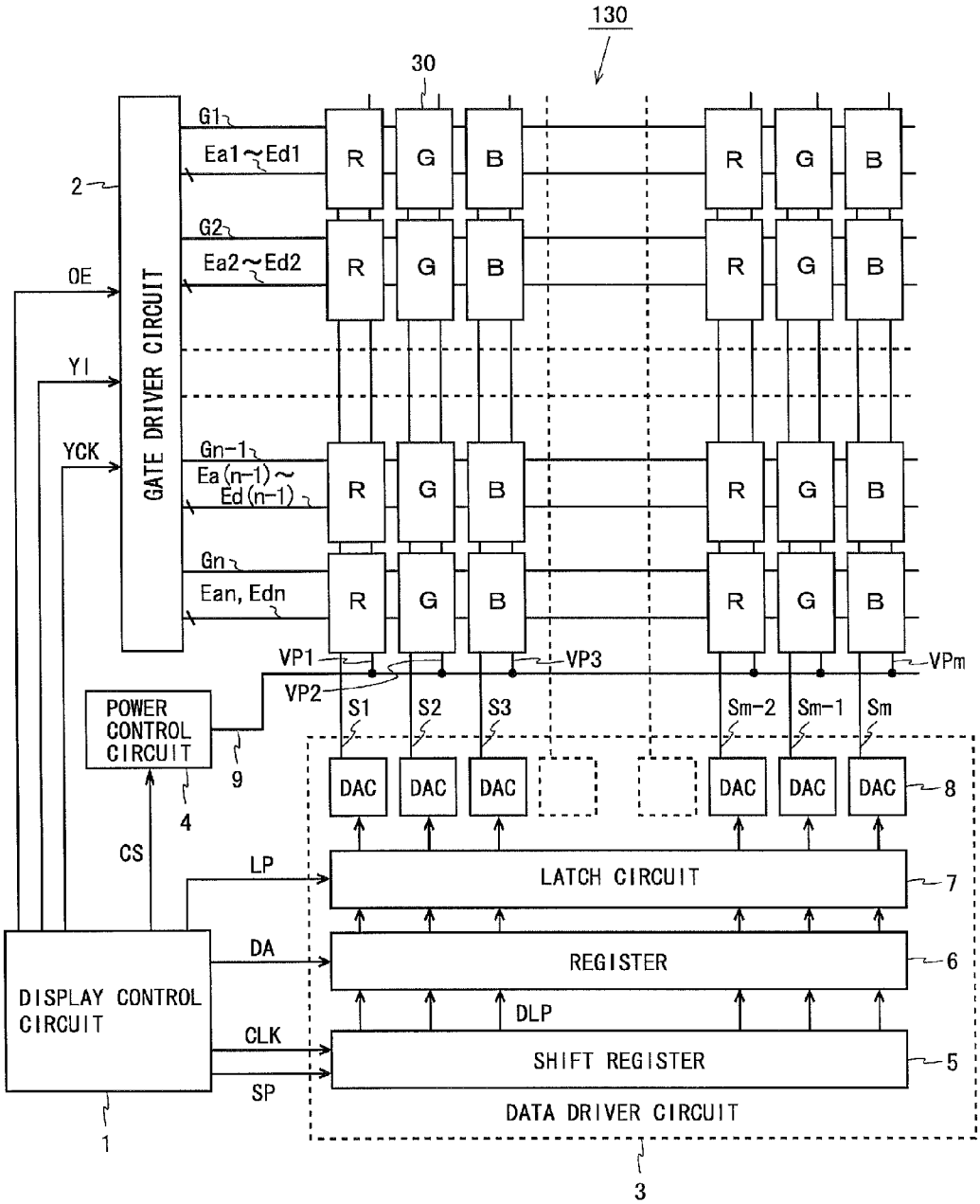
FIG. 11 is a block diagram illustrating the configuration of a display device according to a third embodiment of the present invention.

FIG. 11 is a block diagram illustrating the configuration of a display device according to a third embodiment of the present invention. The display device 130 shown in FIG. 11 has approximately the same configuration as the display device 110 shown in FIG. 1, but the pixel circuit 30 differs in configuration from the pixel circuit 10, and there is a difference in that n sets of four control lines $Ea_i$ to $Ed_i$ are provided in place of the n control lines $E_i$. In addition, unlike in the first embodiment, the power lines $VP_i$ are single lines provided with a power supply potential VDD.

Figure 12:
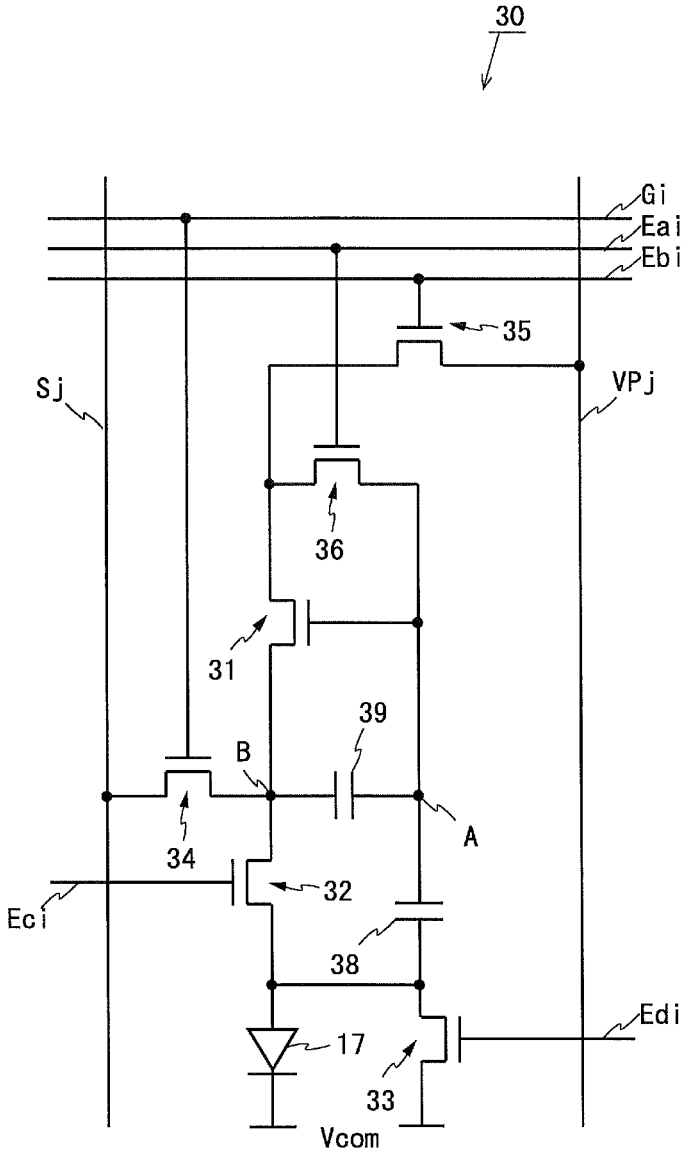
FIG. 12 is a circuit diagram of a pixel circuit in the embodiment.

FIG. 12 is a circuit diagram of the pixel circuit 30. The pixel circuit 30 includes six TFTs 31 to 36, an organic EL element 17, a data holding capacitor 38, and a threshold holding capacitor 39, as shown in FIG. 12. All of the six TFTs 31 to 36 are n-channel transistors. Note that all of them may be p-channel transistors, or n-channel and p-channel transistors may be used in combination depending on the application.

The pixel circuit 30 is connected to a scanning signal line $G_i$, the control lines $Ea_i$ to $Ed_i$, a data line $S_j$, the power line $VP_j$, and an electrode having a common potential Vcom, as shown in FIG. 12. The TFT 31, which is a drive transistor, has a drain terminal connected to the power line $VP_j$ that provides the power supply potential VDD, via the TFT 35 on a current path. Further, The TFT 31 has a source terminal connected to an anode terminal of the organic EL element 17, via the TFT 32 on a current path.

The TFT 36 is connected at one conductive terminal to the drain terminal of the TFT 31 and at the other conductive terminal to a gate terminal of the TFT 31. This allows the TFT 31 to be diode-connected.

Furthermore, the TFT 34 is connected at one conductive terminal to the data line $S_j$ and at the other conductive terminal to one terminal of the threshold holding capacitor 39 and the source terminal of the TFT 31. The other terminal of the threshold holding capacitor 39 is connected to the gate terminal of the TFT 31.

Furthermore, the data holding capacitor 38 is connected at one terminal to the electrode having the common potential Vcom via the TFT 33. Note that it may be connected to a line that provides a potential significantly lower than the power supply potential VDD, rather than the electrode. Further, the data holding capacitor 38 is connected at another terminal to the source terminal of the TFT 31 via the TFT 32. The organic EL element 17 has the common potential Vcom applied at the anode terminal.

The scanning signal line $G_i$ is connected to a gate terminal of the TFT 34. Moreover, the control line $Ed_i$ is connected to a gate terminal of the TFT 33. In addition, the control line $Ea_i$ is connected to a gate terminal of the TFT 36. The TFTs 33, 34, and 36 function as write control transistors. Further, the TFT 33 also functions as a constant-potential supply transistor in order to provide the common potential Vcom or another constant potential to the terminal of the data holding capacitor 38.

The control line $Ec_i$ is connected to a gate terminal of the TFT 32. Moreover, the control line $Eb_i$ is connected to a gate terminal of the TFT 35. The TFTs 32 and 35 function as light-emission control transistors. Note that the TFT 35 also functions as a write control transistor because it is turned on when a data potential Vdata is written.

Next, the operation of the pixel circuit 30 will be described. Initially, at the time of the operation of writing the data potential Vdata, the TFTs 33 to 36 are turned on, so that the data potential Vdata is provided to the other terminal of the data holding capacitor 38. At this time, the TFT 32 is turned off, so that the organic EL element 17 does not emit light.

Thereafter, the TFT 35 is turned off, so that the threshold voltage Vth of the TFT 31 is obtained, and when the source-drain voltage of the TFT 31 is equalized with the threshold voltage Vth, the TFT 31 is turned off, thereby completing the operation of obtaining the threshold voltage. At this time, the potential at the gate terminal of the TFT 31 (node A in FIG. 12) is (Vdata+Vth). Accordingly, the potential (Vdata+Vth) is held in the data holding capacitor 38, and the threshold voltage Vth is held in the threshold holding capacitor 39.

Next, at the time of a light-emitting operation, the TFTs 32 and 35 are turned on, and the TFTs 33, 34, and 36 are turned off, so that a current flows from the power line $Vp_i$ to the organic EL element 17 in accordance with the gate potential of the TFT 31. Here, the data holding capacitor 38 and the threshold holding capacitor 39 are connected at both terminals, so that these two capacitors function as storage capacitance at the time of light emission.

Here, the combined stored charge (Q1+Q2) in the data holding capacitor 38 and the threshold holding capacitor 39 during the writing operation is the same between the time of writing and the time of light emission, as in the first or second embodiment, so that charge redistribution occurs; also when comparing the overdrive voltage Vov of the TFT 31 included in the pixel circuit 30 of the present embodiment with the conventional case, the configuration of the present embodiment renders it possible to suppress the change of the overdrive voltage Vov caused by the change of the power supply potential VDD to c1/(c1+c2), which is more than can be suppressed with the conventional configuration. In this manner, the difference in luminance due to an IR drop caused by the locations of the pixel circuits can be reduced, so that reduction in display quality can be suppressed.

Furthermore, in spite of the threshold holding capacitor 39 being provided additionally, it is still possible to keep the circuit area of the pixel circuit from becoming larger than conventional, as in the first embodiment. Moreover, it is possible to provide an appropriate, not excessive, amount of current to the organic EL element 17 without changing the dynamic range of the data driver circuit 3. In addition, by using the (typical) data driver circuit 3 having a large dynamic range, it is possible to further reduce the error in data potential and thereby suppress variations in pixel luminance due to output deviation of the data driver circuit 3. Further, it is possible to control the organic EL element with a smaller amount of current without changing the size of the TFT 31, which does not involve the need to change design conditions, production processes, etc., resulting in higher flexibility of design.

Fourth Embodiment

Figure 13:
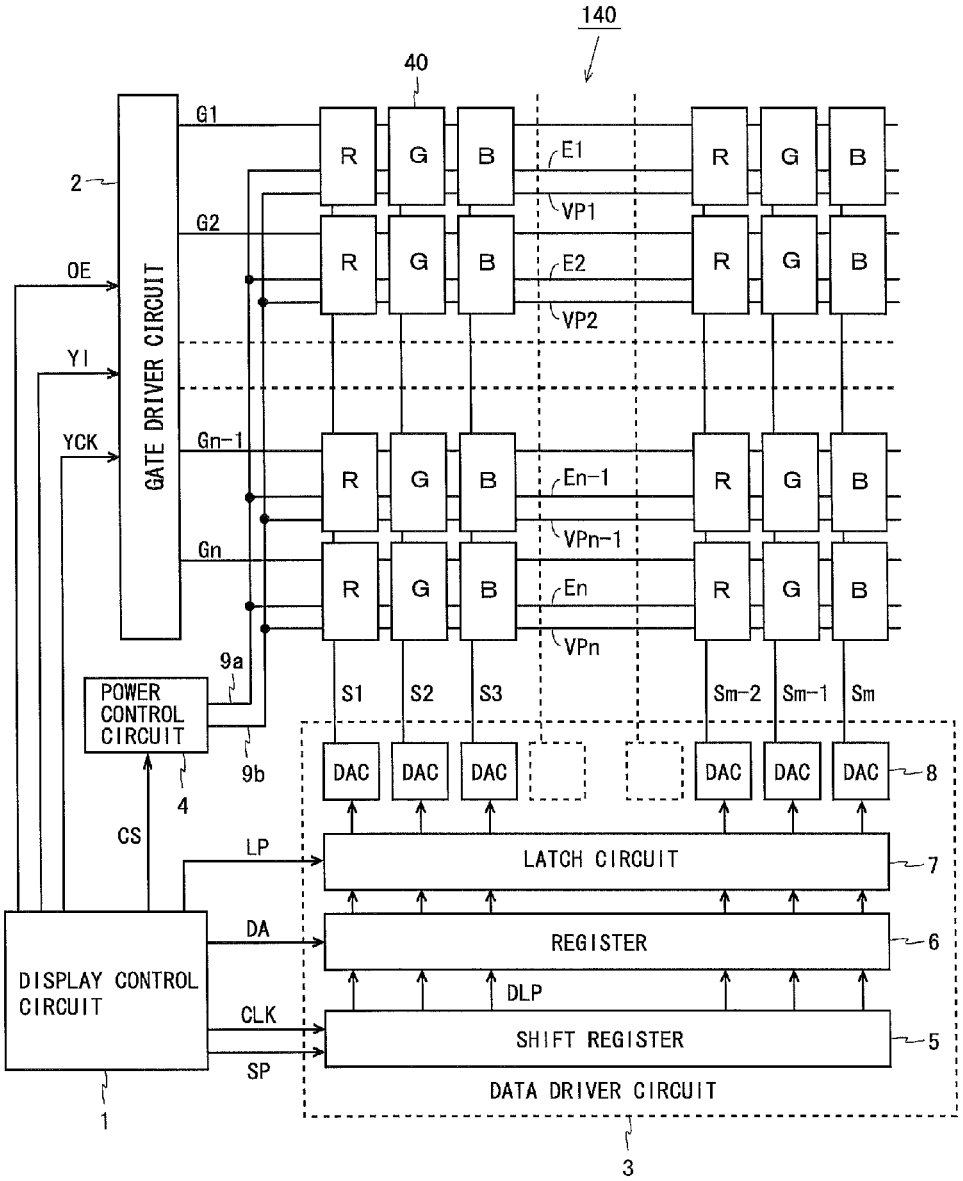
FIG. 13 is a block diagram illustrating the configuration of a display device according to a fourth embodiment of the present invention.

FIG. 13 is a block diagram illustrating the configuration of a display device according to a fourth embodiment of the present invention. The display device 140 shown in FIG. 13 has approximately the same configuration as the display device 110 shown in FIG. 1, but the pixel circuit 40 differs in configuration from the pixel circuit 10, and the n control lines $E_i$ are connected to the power control circuit 4, rather than the gate driver circuit 2, via one common control line (control trunk line) 9*a*. Moreover, unlike in the first embodiment, the power lines $VP_i$ are single lines connected to the power control circuit 4 via one common control line (trunk power line) 9*b* and provided with a power supply potential VDD. In addition, the power lines $VP_i$ are arranged parallel to the scanning signal lines $G_i$, as shown in FIG. 13.

Figure 14:
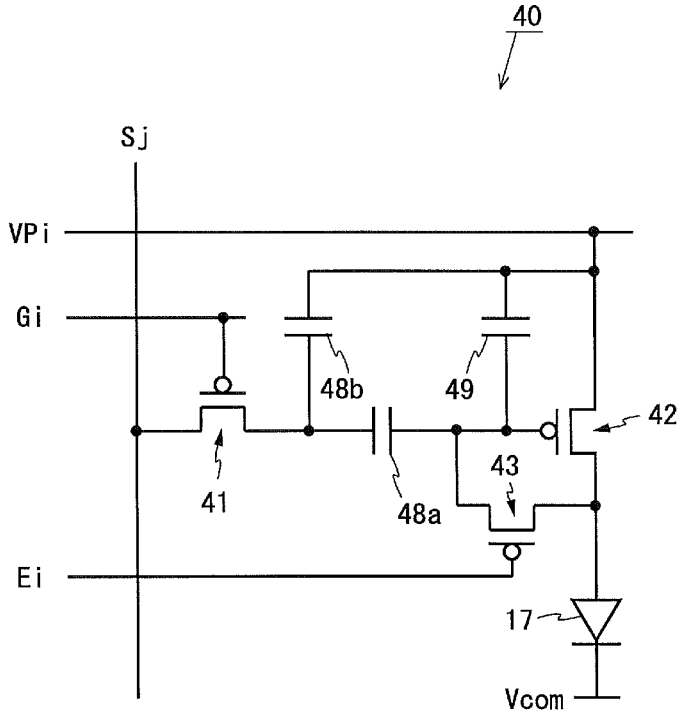
FIG. 14 is a circuit diagram of a pixel circuit in the embodiment.

FIG. 14 is a circuit diagram of the pixel circuit 40. The pixel circuit 40 includes three TFTs 41 to 43, an organic EL element 17, two data holding capacitors 48*a* and 48*b*, and a threshold holding capacitor 49, as shown in FIG. 14. All of the three TFTs 41 to 43 are p-channel transistors. Note that all of them may be n-channel transistors, or p-channel and n-channel transistors may be used in combination depending on the application.

The pixel circuit 40 is connected to a scanning signal line $G_i$, the control line $E_i$, a data line $S_j$, the power line $VP_i$, and an electrode having a common potential Vcom, as shown in FIG. 14. The TFT 41 is connected at one conductive terminal to the data line $S_j$ and at the other conductive terminal to one terminal of each of the two data holding capacitors 48*a* and 48*b*. The two data holding capacitors 48*a* and 48*b* are connected at the other terminal to a gate terminal of the TFT 42 and the power line $VP_i$, respectively. Similarly, the threshold holding capacitor 49 is connected at one terminal to the power line $VP_i$ and at the other terminal to the gate terminal of the TFT 42.

The TFT 42 has a drain terminal connected to the power line $VP_i$ and a source terminal connected to an anode terminal of the organic EL element 17. The organic EL element 17 has a common potential Vcom applied at its cathode terminal. The TFT 43 is connected at one conductive terminal to the gate terminal of the TFT 42 and at the other conductive terminal to the source terminal of the TFT 42. Such connections allow the TFT 42 to be diode-connected.

The scanning signal line $G_i$ is connected to a gate terminal of the TFT 41. The TFT 41 functions as a write control transistor, and also functions as an initialization control transistor because it is turned on during an initialization operation as well. The control line $E_i$ is connected to a gate terminal of the TFT 43. The TFT 43 functions as a light-emission control transistor.

Figure 15:
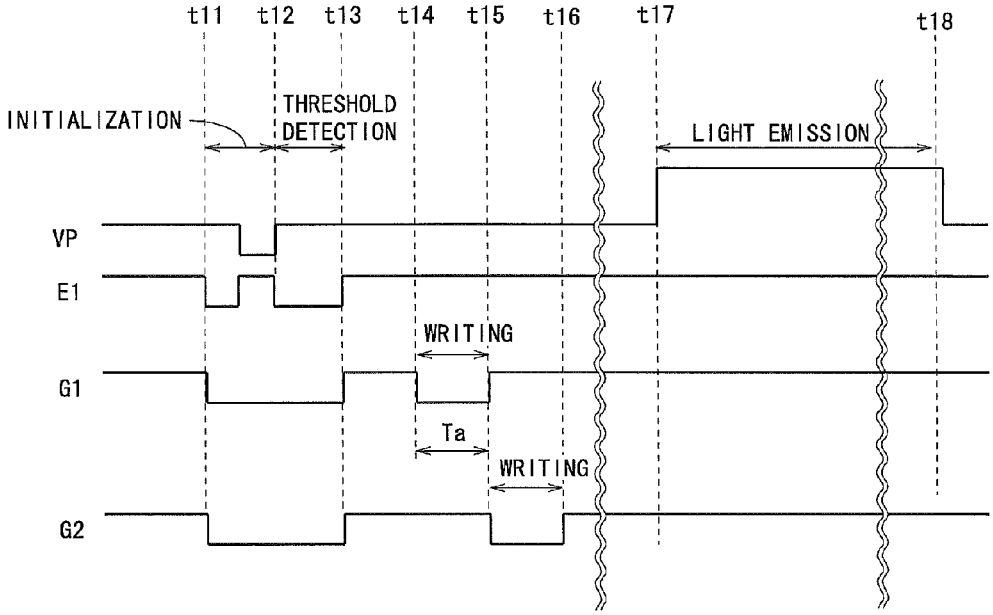
FIG. 15 is a timing chart showing a method for driving the pixel circuit in the embodiment.

FIG. 15 is a timing chart showing a method for driving the pixel circuit 40. The pixel circuit 40 performs initialization, threshold detection (detection of the threshold of the TFT 42), writing, and light emission once every frame period, and does not emit light except during the light emission period. Note that the frame period is a unit of time for displaying an image, which may include, for example, a black insertion period and can be set to various lengths.

The operation of the pixel circuits in the first row will be described below with reference to FIG. 15. Prior to time t11, the potentials of the scanning signal line $G_1$ and the control line $E_1$ are at high level. Moreover, the potential of the power line $VP_1$ is maintained at a first low-potential $VP_L_1$, which is approximately the same as the common potential Vcom. At time t11, the potentials of the control line $E_1$ and the scanning signal lines $G_1$, $G_2$, and so on, change to low level (i.e., active), and the potential of the power line $VP_1$ is maintained at the first low-potential $VP_L_j$. At this time, a first reference potential $Vref_1$ is applied to the data line $S_j$. Further, at this time, initialization is performed as a result of the anode potential of the organic EL element 17 and the gate potential of the TFT 42 being set to a value approximately the same as the common potential Vcom. In addition, the first reference potential $Vref_1$ is provided to one terminal of each of the two data holding capacitors 48*a* and 48*b* via the TFT 41.

Thereafter, up until immediately before time t12, the potentials of the scanning signal lines $G_1$, $G_2$, and so on, are kept at low level, but the potential of the control line $E_1$ changes to high level (i.e., nonactive), and the potential of the power line $VP_1$ changes to a second low-potential $VP_L_2$ lower than the common potential Vcom. As a result, assuming that the capacitance value of the data holding capacitor 48*a* is c1*a*, and the capacitance value of the data holding capacitor 48*b* is c1*b*, the gate potential of the TFT 42 decreases by $(Vref_1-Vref_2)\times c1a/(c1a+c2)$, so that the TFT 42 is turned on, and the charge held at the anode terminal of the organic EL element 17 is released toward the power line $Vp_i$, as can be appreciated with reference to FIG. 14, whereby the potential of the anode terminal changes to the second low-potential $VP_L_2$, so that the anode terminal is initialized. In this manner, the initialization operation including two stages is performed between time t11 and time t12.

At time t12, the potential of the power line $VP_1$ changes to the first low-potential $VP_L_1$, and the potential of the control line $E_1$ changes to low level (i.e., active). Note that the potentials of the scanning signal lines $G_1$, $G_2$, and so on, are maintained at low level. In this manner, the TFT 43 is turned on, so that the TFT 42 is diode-connected, a current flows from the power line $VP_i$ to the gate terminal of the TFT 42, and the potential of the gate terminal rises to the value $(VP_L_1+Vth)$ and is maintained at that value. At this time, the threshold voltage Vth is written to and held in the threshold holding capacitor 49. Here, since the TFT 41 is on, the first reference potential $Vref_1$ is provided to one terminal of each of the two data holding capacitors 48*a* and 48*b*. As a result, the gate potential of the TFT 42 is caused to fluctuate by the data holding capacitor 48*a*, but in actuality, the parasitic capacitance of the organic EL element is relatively significant, and therefore, the amount of potential fluctuations is small. The above operation is a threshold detection operation.

At time t13, the potentials of the control line $E_1$ and the scanning signal lines $G_1$, $G_2$, and so on, change to high level (i.e., nonactive), and thereafter, until their corresponding pixel circuits start a writing operation, the lines are set in standby mode, so that the gate potential of the TFT 42 is maintained at $(VP_L_1+Vth)$.

At time t14, the potential of the scanning signal line $G_1$ is set to high level, so that the TFT 41 is turned on. At this time, a data potential Vdata, which represents an image to be displayed, is applied to the data line $S_j$. Here, the gate potential of the TFT 42 is set to $c1a/(c1a+c2)\times Vdata$, and held in the two data holding capacitors 48*a* and 48*b*, as can be appreciated with reference to FIG. 15.

At time t15, the potential of the scanning signal line $G_1$ is set to high level, so that the TFT 41 is turned off, and the gate potential of the TFT 42 is maintained approximately constant at $(VP_L_1+Vth)$ even if the potential of the data line $S_j$ changes. Thereafter, at time t16, similar operations are performed on the pixel circuits in the next row, so that potentials including the data potential Vdata are written to all pixel circuits.

Here, the combined stored charge (Q1+Q2) of the data holding capacitors 48*a* and 48*b* and the threshold holding capacitor 49 during the writing operation is the same between the time of writing and the time of light emission, as in the above embodiment, so that charge redistribution occurs; also when comparing the overdrive voltage Vov of the TFT 42 included in the pixel circuit 40 of the present embodiment with the conventional case, the configuration of the present embodiment renders it possible to suppress the change of the overdrive voltage Vov caused by the change of the power supply potential VDD to $c1a/(c1a+c2)$, which is more than can be suppressed with the conventional configuration. In this manner, the difference in luminance due to an IR drop caused by the locations of the pixel circuits can be reduced, so that reduction in display quality can be suppressed.

Once the potential applied to the power line $VP_i$ is set to high level at time t17, the organic EL element 17 starts emitting light. The high-level potential is determined such that the TFT 42 can operate in the saturation region during the light-emission period, as described earlier. Accordingly, the current I that flows through the organic EL element 17 changes in accordance with the data potential Vdata, as shown in equation (4), but does not depend on the threshold voltage Vth of the TFT 42. Therefore, even in the case where there are variations in the threshold voltage Vth or the threshold voltage Vth changes over time, it is possible to apply the current to the organic EL element 17 in accordance with the data potential Vdata, thereby allowing the organic EL element 17 to emit light with a desired luminance.

At time t18, the voltage of the power line $VP_i$ changes to the first low-potential $VP_L_1$, and therefore, the TFT 42 is kept in off state after time t17. As a result, no current is applied to the organic EL element 17, so that the pixel circuit 40 stops emitting light.

In this manner, the pixel circuits in the first row perform initialization during the period from time t11 to time t12, threshold detection during the period from time t12 to time t13, writing during the period from time t14 to time t15, and light emission during the period from time t17 to time t18, so that they do not emit light except during the period from time t17 to time t18. The pixel circuits in the second row, as with the pixel circuits in the first row, perform initialization during the period from time t11 to time t12 and threshold detection during the period from time t12 to time t13, and thereafter, they perform writing a predetermined period of time Ta after the pixel circuits in the first row, and start and stop emitting light in the same manner as the pixel circuits in the first row. Typically, the pixel circuits in the i'th row perform initialization and threshold detection during the same periods as the pixel circuits in the other rows, and then perform writing a period of time Ta after the pixel circuits in the (i−1)'th row, and they are turned off after emitting light for the same period as the pixel circuits in the other rows.

Accordingly, the initialization period can be set to an appropriate duration, typically, a duration longer than a selection period, and therefore, drive can be performed properly even if the current capability of an output buffer included in a power control circuit 4*a* is low. Moreover, the threshold detection period can also be set to an appropriate duration, typically, a duration longer than a selection period, and therefore, threshold detection can be reliably performed, resulting in enhanced accuracy in threshold compensation. In addition, when compared to the configuration in which threshold detection is performed during the selection period, it is possible to spare sufficient time for writing pixel data. Therefore, the configuration of the present invention can be readily applied to configurations with shorter write periods, i.e., high-speed drive, such as three-dimensional image display devices (3D televisions).

Figure 16:
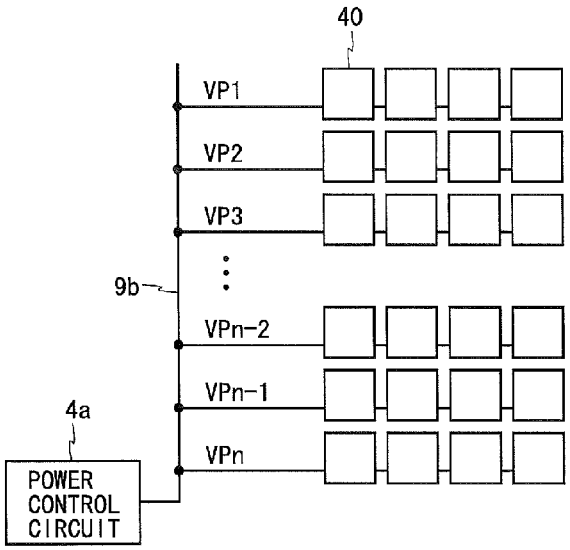
FIG. 16 is a diagram illustrating the connection configuration of power lines VP; in the embodiment.

Next, the connection configuration of the power lines in the present embodiment and the operations of the pixel circuits 40 driven by currents provided through the power lines will be described with reference to FIGS. 16 and 17. FIG. 16 is a diagram illustrating the connection configuration of the power lines $VP_i$ in the display device according to the present embodiment. The display device shown in FIG. 13 is equipped with the trunk power line (common power line) 9*b* in order to connect the power control circuit 4*a* and the power lines $VP_i$. The common power line 9*b* is connected at one terminal to an output terminal of the power control circuit 4*a*, and all of the power lines $VP_i$ are connected to the common power line 9*b*.

Note that the common power line 9*b* is a trunk line for current supply, but in the present embodiment, it does not have to be a trunk line so long as all of the power lines $VP_i$ can be connected commonly to the power control circuit 4*a*, and further, any well-known configuration can be applied in terms of the number of lines and the positions of connections with the power lines $VP_i$.

Figure 17:
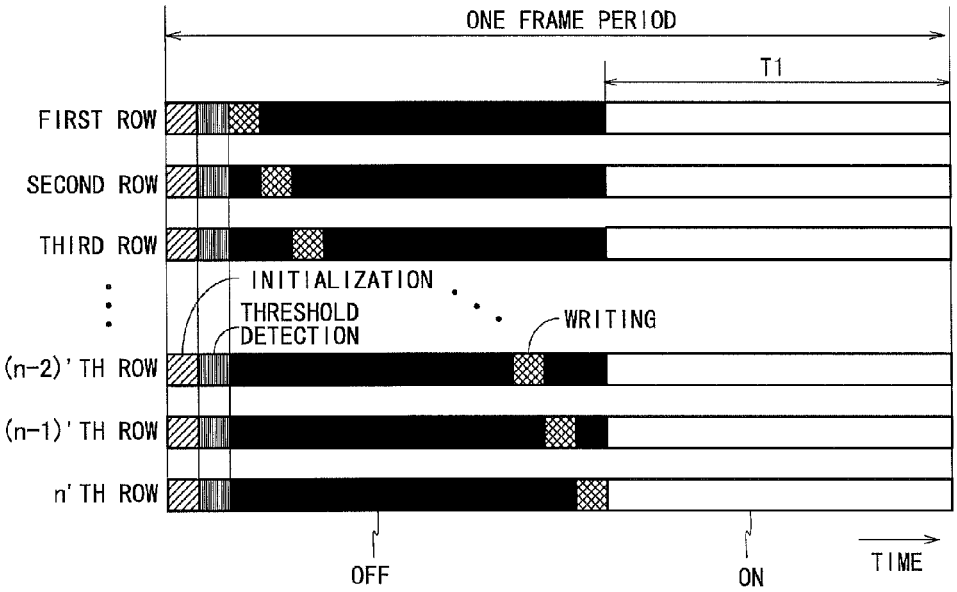
FIG. 17 is a diagram showing the operations of the pixel circuits in rows in the embodiment.

FIG. 17 is a diagram showing the operations of the pixel circuits 40 in rows in the display device according to the present embodiment. The power control circuit 4*a* applies the first low-potential $VP_L_1$ and the second low-potential $VP_L_2$ to the common power line 9*b* each for a predetermined period of time at the beginning of a frame period. Accordingly, the pixel circuits in all rows perform initialization at the beginning of the frame period. Next, immediately after the initialization, the pixel circuits in all rows perform threshold detection. Subsequently, the pixel circuits in the first row are selected and perform writing. Then, the pixel circuits in the second row are selected and perform writing. Thereafter, similarly, the pixel circuits in the third through n'th rows are sequentially selected row-by-row, and the selected pixel circuits perform writing.

The pixel circuits in each row does not emit light for a period after the threshold detection until immediately before writing, and also kept off for a different period of time for each row after the writing, and thereafter, the pixel circuits in all rows emit light at the same time (collectively) for a predetermined period of time T1, and cease to emit light at the same time at the end of the frame period (i.e., immediately before initialization in the next frame). In this manner, the period from the end of the threshold detection to the start of the light emission is set to the same duration among all rows, thereby making it possible to suppress uneven display. Specifically, by setting the period from the end of the threshold detection (at the same point of time among all rows) to the start of the light emission to the same duration among all rows, leakage current in the TFT 42 can be approximately equalized among the pixel circuits 40 in all rows, so that the amount of luminance decay due to leakage current is approximately equalized among the pixel circuits 40 in all rows, resulting in suppression of uneven display.

Note that in the case where the initialization, the threshold detection, and the light emission are performed as described above, their timing is the same among all rows, and therefore, all signals for activating (and deactivating) the control lines $E_i$ are the same. Accordingly, the common control line 9*a* connecting all of the control lines is provided.

Figure 18:
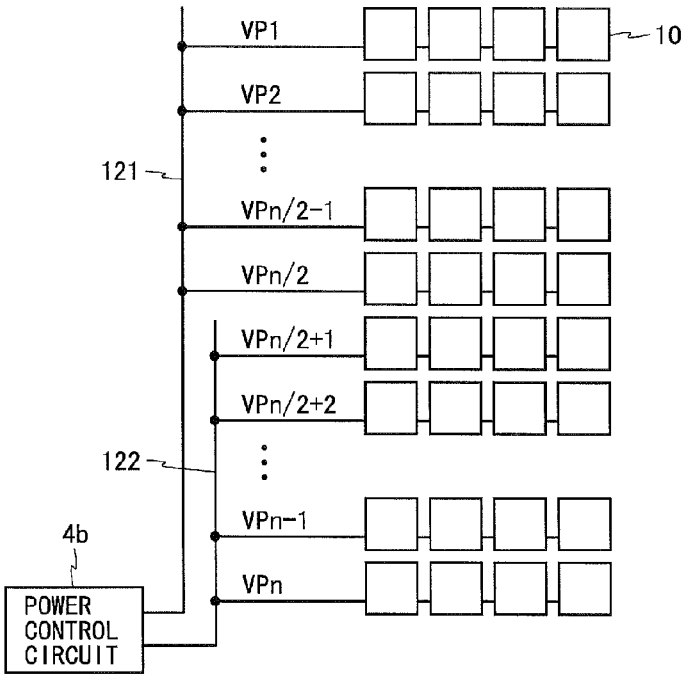
FIG. 18 is a diagram illustrating another example of the connection configuration of the power lines $VP_i$ in the embodiment.

Furthermore, the power lines may be divided into two or more groups, such that each group is driven with different timing. FIG. 18 is a diagram illustrating another example of the connection configuration of the power lines $VP_i$. The display device is equipped with two common power lines 121 and 122 in order to connect a power control circuit 4*b* and the power lines $VP_i$. The common power lines 121 and 122 are connected at one terminal to two output terminals, respectively, of the power control circuit 4*b*. The power lines $VP_i$ to $VP_{n/2}$ are connected to the common power line 121, and the power lines $VP_{n/2+1}$ to $VP_n$ are connected to the common power line 122.

This configuration requires the pixel circuits in all rows to emit light for the same period of time, but unlike in the case shown in FIG. 17 where the initialization is always performed at the beginning of a frame, it is not necessary for the pixel circuits in the n'th row to complete light emission by the end of the frame period. Accordingly, in the example shown in FIG. 18, the speed of scanning the pixel circuits is the same as normal, and the light emission period of the pixel circuits is about ½ of a frame period. Therefore, it is possible to ensure a sufficient period of time for writing as in the normal case. Note that the light emission period may be set shorter than ½ of a frame period while keeping the speed of scanning the pixel circuits the same as normal. Alternatively, the light emission period may be set longer than ½ of a frame period while keeping the speed of scanning the pixel circuits higher than normal.

Figure 19:
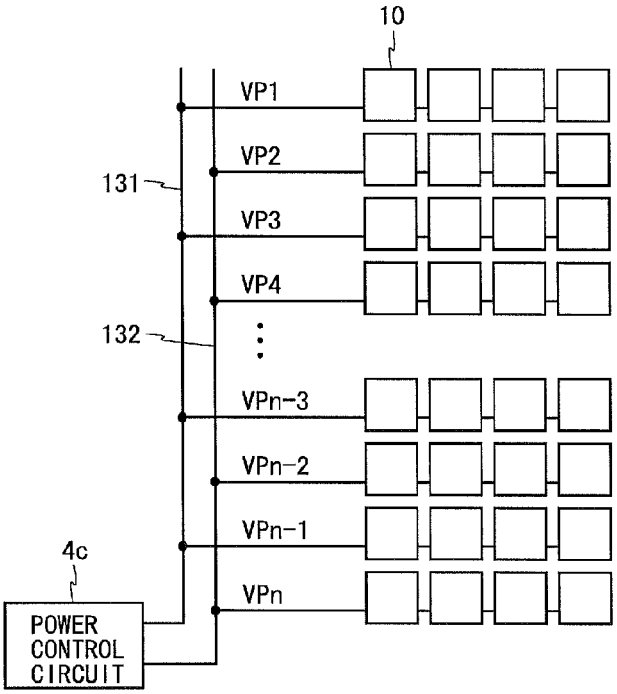
FIG. 19 is a diagram illustrating still another example of the connection configuration of the power lines $VP_i$ in the embodiment.

FIG. 19 is a diagram illustrating still another example of the connection configuration of the power lines $VP_i$. The display device is equipped with two common power lines 131 and 132 in order to connect a power control circuit 4*c* and the power lines $VP_i$. The common power lines 131 and 132 are connected at one terminal to two output terminals, respectively, of the power control circuit 4*c*. The power lines $VP_1$, $VP_3$, and so on, in the odd rows are connected to the common power line 131, and the power lines $VP_2$, $VP_4$, and so on, in the even rows are connected to the common power line 132.

This configuration renders it possible to reduce the difference in luminance on a screen. Specifically, in the case where the amount of current flow varies significantly between the common power lines 121 and 122 in the configuration shown in FIG. 18, e.g., the luminance varies significantly between the upper and lower halves of the screen, the difference in luminance might occur at the center of the screen. However, in the present configuration, the amount of current flow is in many cases approximately the same between the common power lines 131 and 132, so that the difference in luminance that otherwise might occur at the center of the screen can be prevented.

In this manner, the threshold holding capacitor 49 is provided additionally, thereby suppressing the change of the overdrive voltage Vov to c1*a*/(c1*a*+c2) and reducing the difference in luminance due to an IR drop caused by the locations of the pixel circuits, so that reduction in display quality can be suppressed. Moreover, the threshold holding capacitor 49 functions as storage capacitance from the time of writing to the time of light emission and also during the light emission period, as described earlier, and therefore, in spite of the threshold holding capacitor 49 being provided additionally, it is still possible to keep the circuit area of the pixel circuit from becoming larger than conventional.

Note that by providing the two data holding capacitors 48*a* and 48*b*, series capacitance c12 can be freely set therebetween. As a result, the capacitance value of the data holding capacitor 48*b* (and the capacitance value of the threshold holding capacitor 49) can be set appropriately. In this regard, the data holding capacitor 48*b* has the function of an adjustment capacitor.

Furthermore, as in the first embodiment, it is possible to provide an appropriate, not excessive, amount of current to the organic EL element 17 without changing the dynamic range of the data driver circuit 3. Moreover, by using the (typical) data driver circuit 3 having a large dynamic range, it is possible to further reduce the error in data potential and thereby suppress variations in pixel luminance due to output deviation of the data driver circuit 3. Further, it is possible to control a smaller amount of current to the organic EL element without changing the size of the TFT 42, which does not involve the need to change design conditions, production processes, etc., resulting in higher flexibility of design.

INDUSTRIAL APPLICABILITY

The present invention can be applied to active-matrix display devices provided with light-emitting display elements driven by a current, particularly to display devices such as organic EL displays.

DESCRIPTION OF THE REFERENCE CHARACTERS

1 display control circuit
2 gate driver circuit
3 data driver circuit
4 power control circuit
5 shift register
6 register
7 latch circuit
8 D/A converter
9 common power line
10, 20, 30, 40 pixel circuit
11 to 16, 21 to 26, 31 to 36, 41 to 43 TFT
17 organic EL element (electro-optic element)
18, 28, 38, 48 data holding capacitor
19, 29, 39, 49 threshold holding capacitor
110, 120, 130, 140 display device
$G_i$ scanning signal line
$E_i$ control line
$I_i$ initialization control line
$S_j$ data line
$VP_i$ power line

The invention claimed is:

1. An active-matrix color display device comprising:

a plurality of video signal lines configured to transmit signals representing an image to be displayed;

a plurality of scanning signal lines and control lines crossing the video signal lines;

pixel circuits arranged in a matrix corresponding to respective intersections of the video signal lines and the scanning signal lines, each pixel circuit configured to display a pixel in one of a plurality of primary colors for forming the image to be displayed;

a plurality of power lines configured to supply a power-supply voltage to the pixel circuits;

a scanning signal line driver circuit configured to selectively or collectively drive the scanning signal lines and the control lines;

a video signal line driver circuit configured to drive the video signal lines by applying the signals representing the image to be displayed; and a power control circuit configured to drive the power lines, wherein, the pixel circuit includes:

an electro-optic element configured to be driven by a current provided by the power line being supplied with the power-supply voltage;

a drive transistor provided in a path of the current flowing through the electro-optic element, the transistor configured to determine the current to be flowed through the path;

a data holding capacitor connected at one terminal to a control terminal of the drive transistor and at the other terminal to the power line or a connecting point provided with a predetermined voltage;

a write control transistor connected to the data holding capacitor such that a voltage is provided to the data holding capacitor when the write control transistor is on after an initialization operation and in a writing operation before a light emission period, and the provided voltage is held in the data holding capacitor when the write control transistor is off, the provided voltage having a value changed by a predetermined value from a voltage obtained by adding or subtracting a voltage corresponding to a video signal representing an image to be displayed to or from a threshold voltage of the drive transistor; and a threshold holding capacitor connected at one terminal to the control terminal of the drive transistor and at the other terminal to a conductive terminal of the drive transistor or a connecting point provided with a predetermined constant voltage, the write control transistor connected to the data holding capacitor such that a voltage is provided to the threshold holding capacitor when the write control transistor is on after the initialization operation and in the writing operation before the light emission period, and the provided voltage is held in the threshold holding capacitor when the write control transistor is off, the provided voltage being the threshold voltage or having a value changed by a predetermined value from the threshold voltage, the pixel circuits include a first pixel circuit configured to display a first primary color, a second pixel circuit configured to display a second primary color, and a third pixel circuit configured to display a third primary color, and among the first to third pixel circuits, as a service life of the electro-optic element becomes shorter, combined capacitance of the data holding capacitor and the threshold holding capacitor increases and a layout area of the electro-optic element increases.

2. The color display device according to claim 1, wherein the first primary color is blue, the second primary color is green, and the third primary color is red.

3. The color display device according to claim 1, wherein, the first primary color is red, the second primary color is green, and the third primary color is blue, the pixel circuits include a fourth pixel circuit configured to display a fourth primary color, the fourth primary color being white, and a capacitance ratio d of the threshold holding capacitor to the data holding capacitor in the fourth pixel circuit is lower than a capacitance ratio a of the threshold holding capacitor to the data holding capacitor in the first pixel circuit.

4. The color display device according to claim 1, wherein, the first primary color is red, the second primary color is green, and the third primary color is blue, the pixel circuits include a fourth pixel circuit configured to display a fourth primary color, the fourth primary color being yellow, and a capacitance ratio d of the threshold holding capacitor to the data holding capacitor in the fourth pixel circuit is higher than a capacitance ratio a of the threshold holding capacitor to the data holding capacitor in the first pixel circuit.

* * * * *